US007874647B2

(12) United States Patent
Takizawa

(10) Patent No.: US 7,874,647 B2
(45) Date of Patent: Jan. 25, 2011

(54) METHOD FOR DRIVING A LIQUID DROPLET EJECTING HEAD AND LIQUID DROPLET EJECTING DEVICE

(75) Inventor: Fuminori Takizawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 396 days.

(21) Appl. No.: 11/446,884

(22) Filed: Jun. 5, 2006

(65) Prior Publication Data

US 2007/0076027 A1 Apr. 5, 2007

(30) Foreign Application Priority Data

Oct. 5, 2005 (JP) ..... 2005-292537

(51) Int. Cl.
*B41J 2/045* (2006.01)
*B41J 29/38* (2006.01)
*B41J 2/06* (2006.01)

(52) U.S. Cl. ..... 347/68; 347/9; 347/55

(58) Field of Classification Search ..... 347/55, 347/68, 9, 12

See application file for complete search history.

(56) References Cited

U.S. PATENT DOCUMENTS

2005/0041073 A1* 2/2005 Fontaine et al. ..... 347/68
2005/0200657 A1* 9/2005 Nakazawa ..... 347/55

FOREIGN PATENT DOCUMENTS

| | | |
|---|---|---|
| JP | 04-077260 | 3/1992 |
| JP | 10-193587 | 7/1998 |
| JP | 2002-026102 | 1/2002 |

* cited by examiner

*Primary Examiner*—Matthew Luu
*Assistant Examiner*—Jannelle M Lebron
(74) *Attorney, Agent, or Firm*—Fildes & Outland, P.C.

(57) ABSTRACT

A method for driving a liquid droplet ejecting head having plural liquid droplet ejectors that eject liquid droplets from nozzles according to respective voltage changes applied to plural piezoelectric elements electrically connected in a matrix, wherein a switching element being provided with respect to each piezoelectric element and capable of grounding one of a pair of terminals of the piezoelectric element, the method including: inputting, per unit of one column of the piezoelectric elements, a column controlling signal for switching on/off the switching element; inputting, per unit of one row of the piezoelectric elements, a row signal for switching the other of the pair of terminals of the piezoelectric element to a predetermined voltage applied state, a grounded state or an opened state; and ejecting the liquid droplet from the liquid droplet ejector by forming a voltage change between the pair of terminals of the piezoelectric element, is provided.

16 Claims, 17 Drawing Sheets

FIG. 6

| COLUMN CONTROL SIGNAL | | | ROW SIGNAL | | | | PIEZOELECTRIC ELEMENT (PIEZO ACTUATOR) Pzij | | | | | | | | | | | |
|---|---|---|---|---|---|---|---|---|---|---|---|---|---|---|---|---|---|---|
| L1 | L2 | L3 | R1 | R2 | R3 | R4 | Pz11 | Pz21 | Pz31 | Pz41 | Pz21 | Pz22 | Pz32 | Pz42 | Pz13 | Pz23 | Pz33 | Pz43 |
| ON | OFF | OFF | V1 | V1 | V1 | V1 | 0→V1 | 0→V1 | 0→V1 | 0→V1 | M | M | M | M | M | M | M | M |
| OFF | ON | OFF | V1 | V1 | V1 | V1 | M | M | M | M | 0→V1 | 0→V1 | 0→V1 | 0→V1 | M | M | M | M |
| OFF | OFF | ON | V1 | V1 | V1 | V1 | M | M | M | M | M | M | M | M | 0→V1 | 0→V1 | 0→V1 | 0→V1 |
| ON | OFF | OFF | GND | GND | GND | GND | V1→0 | V1→0 | V1→0 | V1→0 | M | M | M | M | M | M | M | M |
| OFF | ON | OFF | GND | GND | GND | GND | M | M | M | M | V1→0 | V1→0 | V1→0 | V1→0 | M | M | M | M |
| OFF | OFF | ON | GND | GND | GND | GND | M | M | M | M | M | M | M | M | V1→0 | V1→0 | V1→0 | V1→0 |
| ON | OFF | OFF | - | - | - | - | M | M | M | M | M | M | M | M | M | M | M | M |
| OFF | ON | OFF | - | - | - | - | M | M | M | M | M | M | M | M | M | M | M | M |
| OFF | OFF | ON | - | - | - | - | M | M | M | M | M | M | M | M | M | M | M | M |
| ON | OFF | OFF | V1 | V1 | V1 | V1 | 0→V1 | 0→V1 | 0→V1 | 0→V1 | M | M | M | M | M | M | M | M |
| OFF | ON | OFF | V1 | V1 | V1 | V1 | M | M | M | M | 0→V1 | 0→V1 | 0→V1 | 0→V1 | M | M | M | M |
| OFF | OFF | ON | V1 | V1 | V1 | V1 | M | M | M | M | M | M | M | M | 0→V1 | 0→V1 | 0→V1 | 0→V1 |
| ON | OFF | OFF | - | - | - | - | M | M | M | M | M | M | M | M | M | M | M | M |
| OFF | ON | OFF | - | - | - | - | M | M | M | M | M | M | M | M | M | M | M | M |
| OFF | OFF | ON | - | - | - | - | M | M | M | M | M | M | M | M | M | M | M | M |
| ON | OFF | OFF | GND | GND | GND | GND | V1→0 | V1→0 | V1→0 | V1→0 | M | M | M | M | M | M | M | M |
| OFF | ON | OFF | GND | GND | GND | GND | M | M | M | M | V1→0 | V1→0 | V1→0 | V1→0 | M | M | M | M |
| OFF | OFF | ON | GND | GND | GND | GND | M | M | M | M | M | M | M | M | V1→0 | V1→0 | V1→0 | V1→0 |
| OFF | OFF | OFF | - | - | - | - | M | M | M | M | M | M | M | M | M | M | M | M |

M:MAINTAINED

FIG. 9

| COLUMN CONTROL SIGNAL | | | ROW SIGNAL | | | | PIEZOELECTRIC ELEMENT (PIEZO ACTUATOR) Pzij | | | | | | | | | | | |
|---|---|---|---|---|---|---|---|---|---|---|---|---|---|---|---|---|---|---|
| L1 | L2 | L3 | R1 | R2 | R3 | R4 | Pz11 | Pz21 | Pz31 | Pz41 | Pz21 | Pz22 | Pz32 | Pz42 | Pz13 | Pz23 | Pz33 | Pz43 |
| ON | OFF | OFF | V1 | - | - | - | 0→V1 | M | M | M | M | M | M | M | M | M | M | M |
| OFF | ON | OFF | - | V1 | V1 | - | M | M | M | M | M | 0→V1 | 0→V1 | M | M | M | M | M |
| OFF | OFF | ON | - | - | - | V1 | M | M | M | M | M | M | M | M | M | M | M | 0→V1 |
| ON | OFF | OFF | GND | - | - | - | V1→0 | M | M | M | M | M | M | M | M | M | M | M |
| OFF | ON | OFF | - | GND | GND | - | M | M | M | M | M | V1→0 | V1→0 | M | M | M | M | M |
| OFF | OFF | ON | - | - | - | GND | M | M | M | M | M | M | M | M | M | M | M | V1→0 |
| ON | OFF | OFF | - | - | - | - | M | M | M | M | M | M | M | M | M | M | M | M |
| OFF | ON | OFF | - | - | - | - | M | M | M | M | M | M | M | M | M | M | M | M |
| OFF | OFF | ON | - | - | - | - | M | M | M | M | M | M | M | M | M | M | M | M |
| ON | OFF | OFF | V1 | - | - | - | 0→V1 | M | M | M | M | M | M | M | M | M | M | M |
| OFF | ON | OFF | - | V1 | V1 | - | M | M | M | M | M | 0→V1 | 0→V1 | M | M | M | M | M |
| OFF | OFF | ON | - | - | - | V1 | M | M | M | M | M | M | M | M | M | M | M | 0→V1 |
| ON | OFF | OFF | - | - | - | - | M | M | M | M | M | M | M | M | M | M | M | M |
| OFF | ON | OFF | - | - | - | - | M | M | M | M | M | M | M | M | M | M | M | M |
| OFF | OFF | ON | - | - | - | - | M | M | M | M | M | M | M | M | M | M | M | M |
| ON | OFF | OFF | GND | - | - | - | V1→0 | M | M | M | M | M | M | M | M | M | M | M |
| OFF | ON | OFF | - | GND | GND | - | M | M | M | M | M | V1→0 | V1→0 | M | M | M | M | M |
| OFF | OFF | ON | - | - | - | GND | M | M | M | M | M | M | M | M | M | M | M | V1→0 |
| OFF | OFF | OFF | - | - | - | - | M | M | M | M | M | M | M | M | M | M | M | M |

M:MAINTAINED

FIG. 14

| COLUMN CONTROL SIGNAL | | | ROW SIGNAL | | | | PIEZOELECTRIC ELEMENT (PIEZO ACTUATOR) Pzij | | | | | | | | | | | |
|---|---|---|---|---|---|---|---|---|---|---|---|---|---|---|---|---|---|---|
| L1 | L2 | L3 | R1 | R2 | R3 | R4 | Pz11 | Pz21 | Pz31 | Pz41 | Pz21 | Pz22 | Pz32 | Pz42 | Pz13 | Pz23 | Pz33 | Pz43 |
| ON | OFF | OFF | V2 | V1 | - | - | 0→V2 | 0→V1 | M | M | M | M | M | M | M | M | M | M |
| OFF | ON | OFF | - | V2 | V1 | - | M | M | M | M | M | 0→V2 | 0→V1 | M | M | M | M | M |
| OFF | OFF | ON | - | - | V2 | V1 | M | M | M | M | M | M | M | M | M | M | 0→V2 | 0→V1 |
| ON | OFF | OFF | - | GND | - | - | M | V1→0 | M | M | M | M | M | M | M | M | M | M |
| OFF | ON | OFF | - | - | GND | - | M | M | M | M | M | M | V1→0 | M | M | M | M | M |
| OFF | OFF | ON | - | - | - | GND | M | M | M | M | M | M | M | M | M | M | M | V1→0 |
| ON | OFF | OFF | GND | V1 | - | - | V2→0 | 0→V1 | M | M | M | M | M | M | M | M | M | M |
| OFF | ON | OFF | - | GND | V1 | - | M | M | M | M | M | V2→0 | 0→V1 | M | M | M | M | M |
| OFF | OFF | ON | - | - | GND | V1 | M | M | M | M | M | M | M | M | M | M | V2→0 | 0→V1 |
| ON | OFF | OFF | V1 | - | - | - | 0→V1 | M | M | M | M | M | M | M | M | M | M | M |
| OFF | ON | OFF | - | V1 | - | - | M | M | M | M | M | 0→V1 | M | M | M | M | M | M |
| OFF | OFF | ON | - | - | V1 | - | M | M | M | M | M | M | M | M | M | M | 0→V1 | |
| ON | OFF | OFF | - | GND | - | - | M | V1→0 | M | M | M | M | M | M | M | M | M | M |
| OFF | ON | OFF | - | - | GND | - | M | M | M | M | M | M | V1→0 | M | M | M | M | M |
| OFF | OFF | ON | - | - | - | GND | M | M | M | M | M | M | M | M | M | M | M | V1→0 |
| ON | OFF | OFF | GND | - | - | - | V1→0 | M | M | M | M | M | M | M | M | M | M | M |
| OFF | ON | OFF | - | GND | - | - | M | M | M | M | M | V1→0 | M | M | M | M | M | M |
| OFF | OFF | ON | - | - | GND | - | M | M | M | M | M | M | M | M | M | M | V1→0 | M |
| OFF | OFF | OFF | - | - | - | - | M | M | M | M | M | M | M | M | M | M | M | M |

M:MAINTAINED

METHOD FOR DRIVING A LIQUID DROPLET EJECTING HEAD AND LIQUID DROPLET EJECTING DEVICE

CROSS-REFERENCE TO RELATED APPLICATION

This application claims priority under 35 USC 119 from Japanese Patent Application No. 2005-292537, the disclosure of which is incorporated by reference herein.

BACKGROUND

1. Technical Field

The present invention relates to a method for driving a liquid droplet ejecting head and a liquid droplet ejecting device for ejecting liquid droplets of an ink or the like.

2. Related Art

As the liquid droplet ejecting device, there is an ink jet recording device having an ink jet recording head as the liquid droplet ejecting head. Moreover, as the ink jet recording device, in addition to the thermal system, there are those using the piezoelectric system using a piezoelectric element such as a piezo element.

As the ink jet recording device using a piezoelectric element, there are those using the so-called drop-on-demand system, in which ink liquid droplet is ejected from the nozzle top end communicating with a pressure generating chamber by changing internal pressure of the pressure generating chamber by changing the volume (capacity) of the pressure generating chamber by carrying out expansion, contraction or the like of the pressure generating chamber filled with an ink by means of a piezoelectric element.

In general, an ink jet recording head is provided with a switching element per piezoelectric element so as to control the ink liquid droplet ejection from the nozzle by applying/stopping a driving voltage according to on/off operation of the switching element.

Therefore, the ink jet recording head needs to connect a signal line for driving the switching element connected for each piezoelectric element. Moreover, in the case the number of the switching elements for controlling the drive of one piezoelectric element is increased, the signal lines are required for the number of the switching elements. Moreover, due to the concentration of the piezoelectric elements accompanied by the high density of the nozzles, the wiring is complicated so that the wiring work becomes difficult as well.

In order to realize the recent drop size modulation (liquid droplet volume modulation) aiming at the high image quality recently, plural driving waveforms should be generated at the same time, and therefor, the number of the switching elements is increased as well as the number of the wirings between an IC as a set of the switching elements and a control substrate is increased so as to complicate the process.

As to the wiring from the control substrate to the switching element IC, a method realizing the droplet size modulation by successively generating plural driving waveforms in one cycle of the printing and controlling the IC so as to select an arbitrary driving waveform, has been proposed.

However, in this proposal, independent wirings are required for each piezoelectric element, accordingly, with respect to a large number of nozzles and the high density, the wiring complication between the switching element and the piezoelectric element cannot be solved. Moreover, as it will be described later, due to the long driving waveform, it is not suitable for the high speed printing.

On the other hand, as a method for reducing parts and the wirings between the piezoelectric element and the switching element, an ink jet printer that drives piezoelectric elements per block (plural driving elements are divided into plural blocks), has been proposed.

For the ink jet recording device, as in the case of the other image recording devices, high image quality and high speed are required.

As mentioned above, in the ink jet recording device, the printing gradation can be improved by the dot size modulation (liquid droplet modulation) for adjusting ejection droplet amount by controlling the waveform of the driving voltage (driving waveform) to be applied to the piezoelectric element, or the like, moreover, by high density of the nozzles provided for ejecting the ink liquid droplets to the ink jet recording head, the printing speed can be improved as well as the high image quality can be achieved.

However, in the piezoelectric element type ink jet recording device, a driving waveform whose length is a several tens of μsec for controlling the pressure fluctuation in the ejector is needed. In the conventional art, the dividing number of the blocks is limited depending upon the length of the driving waveform to be generated in a printing cycle. Moreover, there is a problem in that, for each block, the impact position of the liquid droplet onto a recording paper can be displaced per block according to the number of the division of the resolution.

Moreover, in the thermal system, because of short driving time (voltage application time), plural pressure generating elements may be driven using the matrix drive system by time sharing, according to the piezoelectric element such as the piezo element, however, for the piezoelectric element such as the piezo element, pressure wave control in the ejector is needed, therefore, it is difficult to shorten the driving time compared with the pressure generating element of the thermal system. Therefore, in order to apply a predetermined driving waveform to plural piezoelectric elements in one printing cycle, the number of the piezoelectric elements is limited. Moreover, there is a problem in that the printing speed is made sacrifice for applying a predetermined driving waveform to each of the piezoelectric elements so that the high speed can hardly be achieved.

SUMMARY

The present invention provides a method for driving a piezoelectric element and a liquid droplet ejecting device, capable of simplifying wirings or the like without hindering the high image quality and the high speed.

An aspect of the present invention is a method for driving a liquid droplet ejecting head having plural liquid droplet ejectors that eject liquid droplets from nozzles according to respective voltage changes applied to plural piezoelectric elements electrically connected in a matrix, wherein a switching element being provided with respect to each piezoelectric element and capable of grounding one of a pair of terminals of the piezoelectric element, the method including: inputting, per unit of one column of the piezoelectric elements, a column controlling signal for switching on/off the switching element; inputting, per unit of one row of the piezoelectric elements, a row signal for switching the other of the pair of terminals of the piezoelectric element to a predetermined voltage applied state, a grounded state or an opened state; and ejecting the liquid droplet from the liquid droplet ejector by forming a voltage change between the pair of terminals of the piezoelectric element.

BRIEF DESCRIPTION OF THE DRAWINGS

Embodiments of the invention will be described in detail with reference to the following figures, wherein:

FIG. 6 is a chart showing the applied voltage state of the piezoelectric elements according to the column control signal and the row signal using the matrix driving circuit according to the first embodiment;

FIG. 9 is a chart showing the applied voltage state of the piezoelectric elements according to the column control signal and the row signal equivalent to FIGS. 8A to 8C;

FIG. 14 is a timing chart showing the change of the terminal voltage of the piezoelectric elements (driving waveform) based on FIGS. 13A and 13B;

DETAILED DESCRIPTION

Hereinafter, exemplary embodiments of the present invention will be explained with reference to the drawings.

First Embodiment

Figure 1:
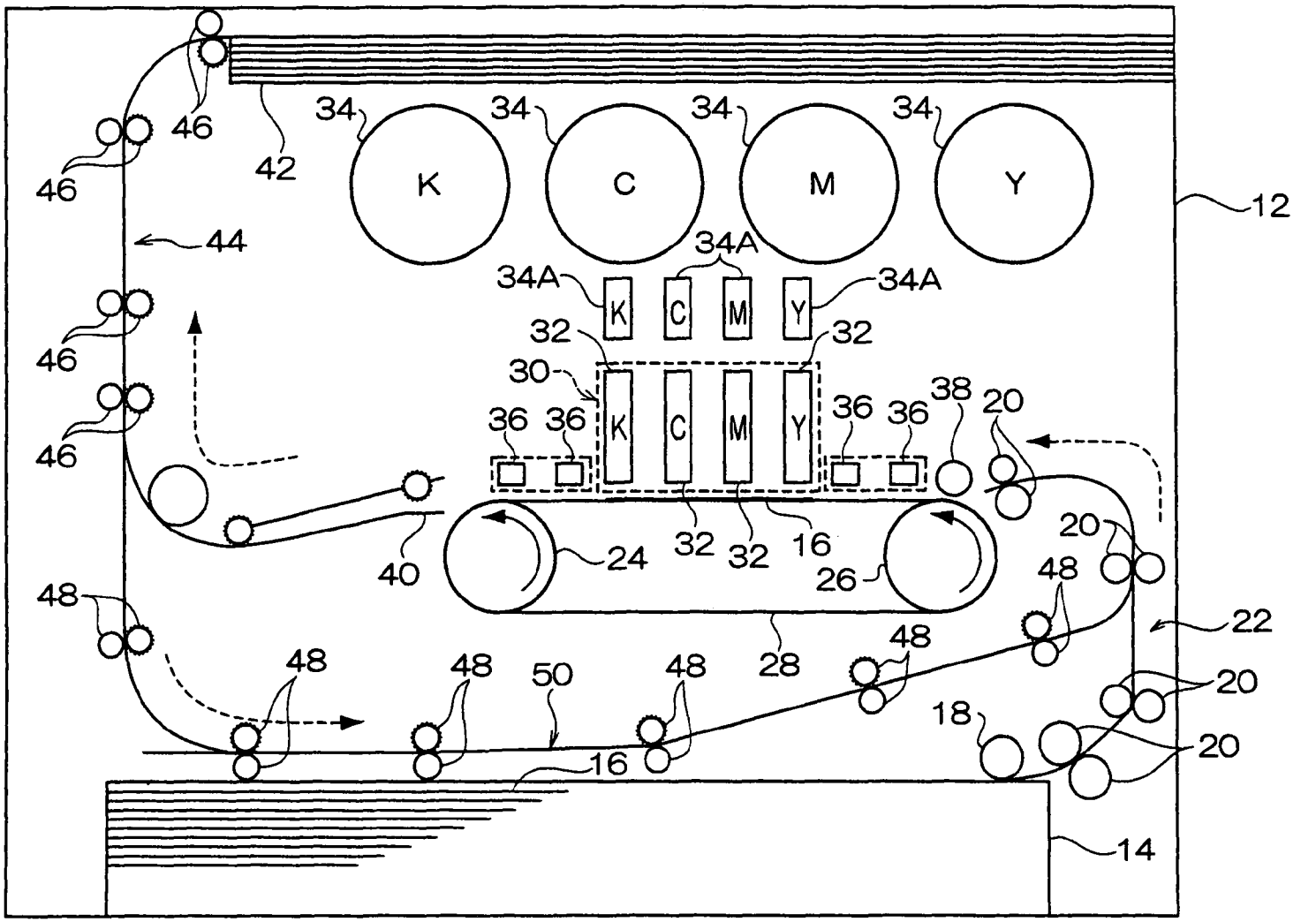
FIG. 1 is a schematic configuration diagram of an ink jet recording device according to an embodiment.

FIG. 1 shows the schematic configuration of an ink jet recording device 10 used as a liquid droplet ejecting device as a first embodiment.

The ink jet recording device 10 includes a paper feeding tray 14 in the lower part of a housing 12. The paper feeding tray 14 is for storing papers 16 as recording medium in a laminated state so that the papers 16 stored in the paper feeding tray 14 are taken out one by one from the uppermost layer by a pick up roll 18.

The paper 16 taken out from the paper feeding tray 14 is conveyed along a paper feeding conveyance path 22 formed in the housing 12 by plural conveyance roller pairs 20.

An endless conveyance belt 28 is disposed across a driving roll 24 and a driven roll 26 above the paper feeding tray 14 in the housing 12. The conveyance belt 28 is to be moving-circulated according to the rotation drive of the driving roll 24.

Moreover, a recording head array 30 as a liquid droplet ejecting head is provided above the conveyance belt 28. The recording head array 30 faces a flat portion of the conveyance belt 28 between the driving roll 24 and the driven roll 26 such that the region facing the recording head array 30 is provided as an ejected region for having the ink liquid droplets ejected from the recording head array 30.

The paper 16 conveyed on the conveyance path 22 is supported by the conveyance belt 28 so as to be conveyed to the ejected region. The recording head array 30 ejects the ink liquid droplets according to the image information at the time the paper 16 passes by the ejected region to adhere the ejected ink liquid droplets on the paper 16 so as to execute the image recording on the paper 16 according to the image information.

Moreover, according to ink jet recording device 10, by circulating the paper 16 in a state supported by the conveyance belt 28 so as to pass by the ejected region for plural times, the so-called multi pass image recording can be enabled.

Instead of providing the conveyance belt 28, a configuration with the paper 16 facing the ejected region by supporting and rotating the paper 16 by vacuuming or the like on the outer circumference of the conveyance roll formed cylindrically or column like may be adopted as well. In this case, a space between the recording head array and the paper 16 can be provided substantially evenly in the ejected region by curving the ejected region along the circumferential surface of the conveyance roller, or the like.

The recording head array 30 of the ink jet recording device 10 used for this embodiment is configured lengthily such that a length of the effective image recording region (the ink liquid droplet ejected region) is equal to or more than a paper width as a length of the paper 16 in the direction orthogonal to the conveyance direction of the paper 16. Four ink jet recording head units (hereinafter they will be referred to simply as the head units 32) corresponding to four colors of yellow (Y), magenta (M), cyan (C) and black (K) are arranged along the conveyance direction. Thereby, the full color image recording can be enabled in the ink jet recording device 10.

Although the recording head array 30 does not move along the direction orthogonal to the conveyance direction, as needed, it may be provided movably. Thereby, image recording can be enabled with a higher resolution in the multi pass image recording, and/or it is possible that liquid droplet ejection undesired-problems do not appear in the recording results. The recording head array 30 is not limited to the same, and it may be moved in the main scanning direction with the width direction of the paper 16 regarded as the main scanning direction.

Ink tanks 34 for storing the Y, M, C and K ink liquids are provided inside the housing 12 such that a reservoir tank 34A corresponding to the ink tank 34 is provided for each of the head unit 32. The ink liquid in the ink tank 34 is supplied to the reservoir tank 34A via an unshown ink supply pipe according to the ejection of the ink liquid in the reservoir tank 34A from each of the head units 32 toward the paper 16.

Moreover, four maintenance units 36 are disposed corresponding to each of the four head units 32 in the vicinity of the recording head array 30. At the time of executing the maintenance of the head units 32 using the maintenance units 36, the maintenance units 36 are moved to a space formed between the conveyance belt 28 and the recording head array 30 so as to have each of the maintenance units 36 facing the nozzle surfaces (surface on the conveyance belt 28 side) of the head units 32.

In this state, the maintenance units 36 carries out a predetermined maintenance operation such as vacuuming, dummy jet, wiping and capping. The maintenance units 36, divided into two sets each of which includes two units, are disposed on the conveyance direction upstream side and the downstream side of the paper 16 with respect to the recording head array 30.

A charging roll 38 is provided facing the conveyance belt 28 on the conveyance path 22 side of the recording head array 30 in the ink jet recording device 10. The charging roll 38 is moved between a pressing position for pressing the paper 16 against the conveyance belt 28 and a separated position away from the conveyance belt 28 by being driven while clamping the paper 16 with the conveyance belt 28 with respect to the driven roll 26.

The charging roll 38 has the paper 16 stuck to the conveyance belt 28 electrostatically by supplying power of a predetermined voltage from an unshown power source so as to generate a potential difference with respect to the grounded driven roll 26 and providing the potential difference to the paper 16 by the potential difference. An unshown regi roll is provided on the upstream side of conveyance direction of the paper 16 from the charging roll 38 in the ink jet recording device 10 so as to position the paper 16 fed between the conveyance belt 28 and the charging roll 38 by the regi roll.

A separating plate 40 is provided on downstream side of the conveyance direction of the paper 16 so that the paper 16 after recording the image is separated from the conveyance belt 28 by the separating plate 40. A cleaning roll (not shown) for clamping the conveyance belt 28 with the driving roll 24 is disposed below the separating plate 49 so that the surface of the conveyance belt 28 after separating the paper 16 can be cleaned by the cleaning roll.

A paper discharging tray 42 is provided in the upper part of the housing 12 and a paper discharging conveyance path 44 for conveying the paper 16 toward the paper discharging tray 42 is formed on the paper conveyance direction downstream side of the separating plate 40.

The paper discharging conveyance path 44 includes a plurality of conveyance roller pairs 46 such that the paper 16 separated from the conveyance belt 28 by the separating plate 40 is conveyed by the conveyance roller pairs 46 so as to be discharged and accumulated on the paper discharging tray 42.

Moreover, an inverting conveyance path 50 is formed with a plurality of conveyance roller pairs 48 between the paper feeding tray 14 and the conveyance belt 28.

The paper 16 with the image recording formed on one side and fed to the paper discharging conveyance path 44 is fed to the inverting conveyance path 50 so as to be sent to the paper feeding conveyance path 22. Thereby, the image recording operation can be enabled on the both side of the paper 16 in the ink jet recording device 10.

Figure 2:
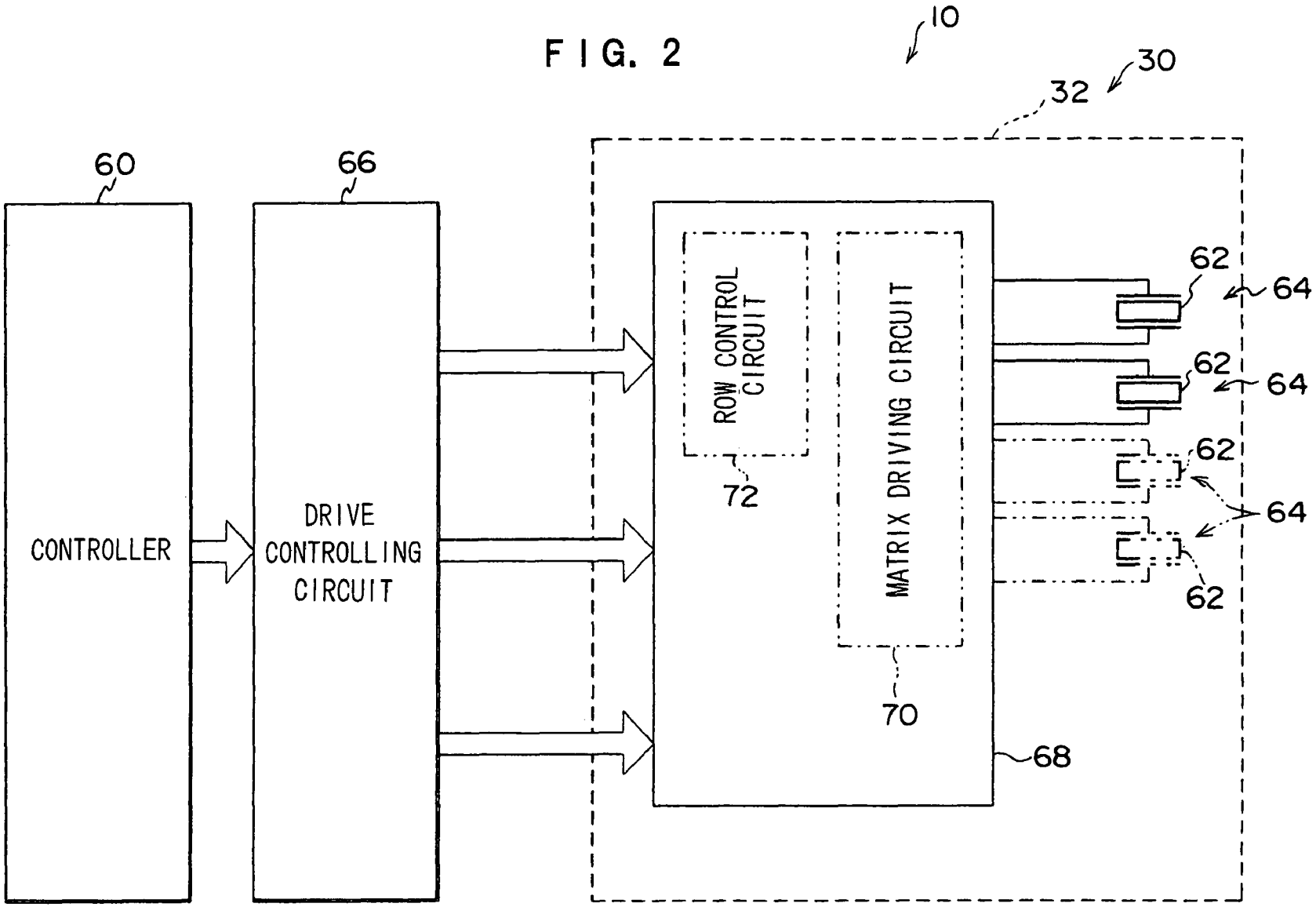
FIG. 2 is a schematic configuration diagram of the ejection control of the ink liquid droplets.

On the other hand, as shown in FIG. 2, the ink jet recording device 10 includes a controller 60 for controlling the ejection of the ink liquid droplets using the recording head array 30. To the ink jet recording device 10, image data are inputted from an image processing device such as a personal computer and a work station so that the controller 60 executes the image recording according to the image data on the paper 16 by controlling the ink liquid droplet ejection by each head unit 32 of the recording head array 30 according to the inputted image data.

As mentioned above, the recording head array 30 is longer than the width of the paper 16, and each color head unit 32 has nozzles for ejecting ink liquid droplets arranged densely along the width direction of the paper 16.

The head units 32 have the nozzles by plural rows, for example 4 rows with the nozzles of each row provided two dimensionally so as not to be superimposed along the conveyance direction of the paper 16 so that the nozzles can be arranged densely in the width direction of the paper 16. Moreover, the configuration of the liquid droplet ejecting head with the present invention applied is not limited thereto, and an optional configuration can be used.

According to the ink jet recording device 10 with the configuration mentioned above, when the image data is inputted, the paper 16 stored and loaded in the paper feeding tray 14 is conveyed on the conveyance path 22 to between the driven roll 26 and the charging roll 38. When the paper 16 is sent between the driven roll 26 and the charging roll 38, it is clamped by the driven roll 26 and the charging roll 38 together with the conveyance belt 28, and pressed against the conveyance belt 28 so as to be supported on the conveyance belt 28.

When the paper 16 supported on the conveyance belt 28 passes by the ejected region facing the head units 32 of the recording head array 30 according to the circulation movement of the conveyance belt 28, the image recording is executed based on the image data by ejecting the ink liquid droplets according to the image data from the head units 32.

Here, in the case the image recording is carried out by only one pass, the paper 16 is separated from the conveyance belt 28 by the separating plate 40 so that the separated paper 16 is conveyed along the paper discharging conveyance path 44 so as to be discharged onto the paper discharging tray 42. Moreover, in the case the image recording is carried out by multi pass, the paper 16 passes by the ejected region for plural times for the image recording according to the circulation movement of the conveyance belt 28. At the time the image recording is finished, the paper 16 is separated from the conveyance belt 28 so as to be discharged onto the paper discharging tray 42.

A liquid droplet ejector 64 for ejecting the ink liquid droplets is disposed in the head units 32. In the liquid droplet ejector 64, a pressure generating element, a pressure chamber and a nozzle part are formed. Moreover, the liquid droplet ejector 64 uses a piezoelectric element 62 using a piezo element, or the like as the pressure generating element to be provided as an actuator. The piezoelectric element 62 is deformed by the applied voltage so as to vibrate the vibrating plate structuring a part of the wall surface of an unshown pressure chamber (pressure generating chamber) of the liquid droplet ejector 64. The liquid droplet ejector 64 ejects the ink liquid droplets in the pressure generating chamber from the nozzle by expanding or contracting the pressure generating chamber by the vibration of the vibrating plate.

As such a liquid droplet ejector 64, a known common configuration using a piezoelectric element 62 can be used, and thus detailed explanation is omitted. Moreover, since the basic configuration of the head units 32 of each color of Y, M, C, K provided in the recording head array 30 is same, a head unit 32 for one color will be explained hereinafter.

The controller 60 is provided with a driving control circuit 66 using a driving IC (integrated circuit), or the like. Power of a predetermined voltage is supplied for driving the piezoelectric element 62 to the driving control circuit 66 from an unshown power source circuit.

The driving control circuit 66 may be provided, for example, for each color head unit 32 of Y, M, C, K so as to be connected to the controller 60 independently, or the head units 32 of Y, M, C, K colors may be connected to one driving control circuit 66.

The controller 60 carries out the image recording on the paper 16 according to the image data by outputting a clock signal, printing data according to the image data, and a latch signal or the like to the driving control circuit 66 and carrying out control of power to be outputted to each piezoelectric element 62 of the head unit 32 from the driving control circuit 66 to control the ejected droplet amount from the nozzle of each liquid droplet ejector 64 of the head unit 32.

On the other hand, the head unit 32 is provided with a driving circuit 68 using a switch IC forming a transfer gate. A matrix driving circuit 70 and a row controlling circuit 72 are formed in the driving circuit 68.

In this embodiment, with m pieces of the piezoelectric elements 62 provided as one set and n sets provided as one block, a large number of the piezoelectric elements 62 provided in the head unit 32 are divided into plural blocks so that the matrix driving circuit 70 and the row controlling circuit 72 are provided for each divided block.

The driving control circuit 66 outputs a predetermined control signal to the matrix driving circuit 70 and the row controlling circuit 72. Based on the control signal inputted from the driving control circuit 66 and the control signal inputted from the row control circuit 72, the matrix driving circuit 70 controls the voltage to be applied to each piezoelectric element 62 for one block (m×n pieces).

As one block, for example, since the nozzles are arranged two dimensionally in the head unit 32, the blocks can be provided in the width direction of the paper 16, with the piezoelectric elements 62 corresponding to the m rows as one set along the width direction of the paper 16 with respect to the number of the columns n.

Here, in this embodiment, as an example, 12 pieces of 4 rows×3 columns (m=4, n=3) of the piezoelectric elements 62 are provided as one block so that an example of the piezoelectric elements 62 of one block will be explained.

In the driving control circuit 66, the drop-on-demand system of ejecting the ink liquid droplets from the nozzle by providing a predetermined driving waveform for each piezoelectric element 62 is used.

When a predetermined voltage is applied, the piezoelectric element 62, equivalent to a capacitor is charged so that the terminal voltage becomes that voltage. And furthermore, by being connected to GND (0 v), the accumulated electric charge is discharged so as to have the terminal voltage to be 0 v. Furthermore, by opening at least one of the terminals, in a state charged to a predetermined voltage, the piezoelectric element 62 maintains the charged state.

In the liquid droplet ejector 64, when the piezoelectric element 62 is charged or it is discharged from the charged state, the unshown vibrating plate is vibrated in a direction to enlarge or contract the pressure generating chamber. Thereby the ink liquid in the pressure generating chamber is ejected from the nozzle by the expansion or contraction of the pressure generating chamber. That is, by switching the voltage application to the piezoelectric element 62 from on to off or from off to on, the ink liquid droplets are ejected from the nozzle.

Moreover, by changing the applied voltage at "on" time or on/off timing, and/or repeating on/off or off/on in a printing cycle for one dot (hereinafter, it is referred to simply as the printing cycle), the ejection droplet amount is changed.

Figure 3:
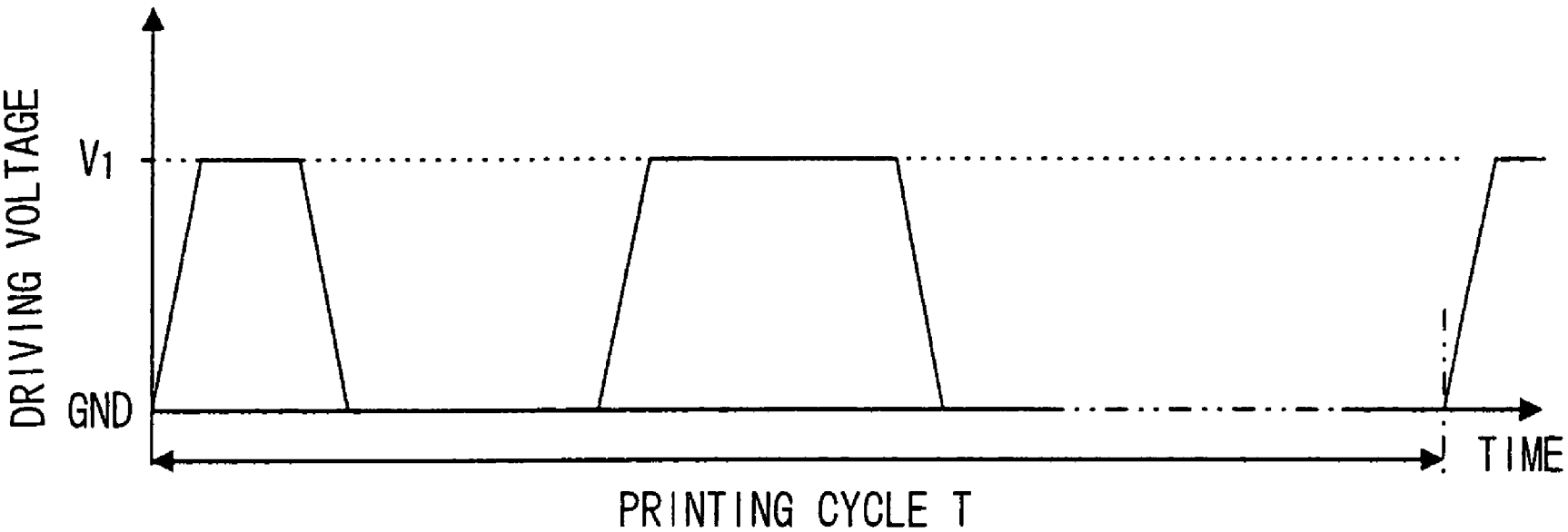
FIG. 3 is a linear diagram showing schematically the driving waveform of the piezoelectric elements according to a first embodiment.

Here, as shown in FIG. 3, in the first embodiment, with the driving voltage (applied voltage) V of the piezoelectric element 62 being as $V_1$, and ejecting the ink liquid droplets by at least two on/off operations in one printing cycle T from the discharged state (0 v) is carried out. By increasing the number of on/off, the size of the dot (1 dot) formed in the printing cycle T is made larger or stable ejection is enabled.

Figure 4A:
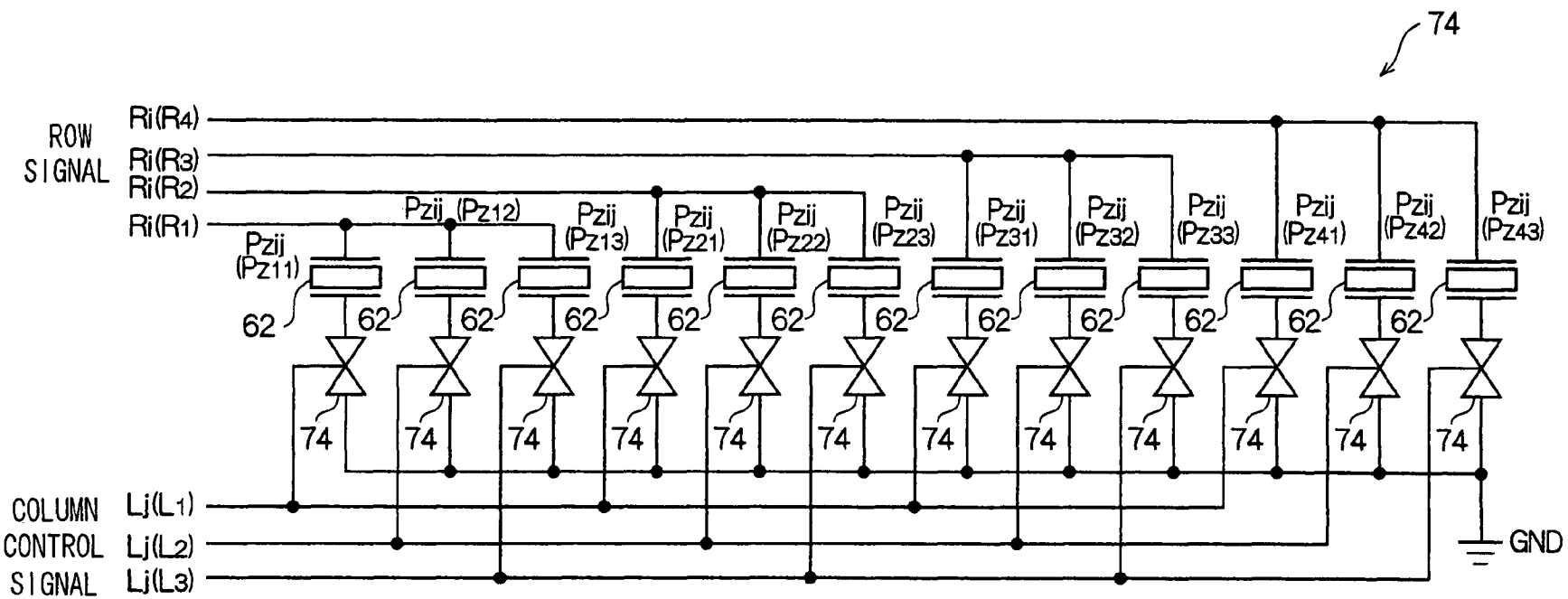
FIG. 4A is a schematic circuit diagram showing a matrix driving circuit according to the embodiment.
Figure 4B:
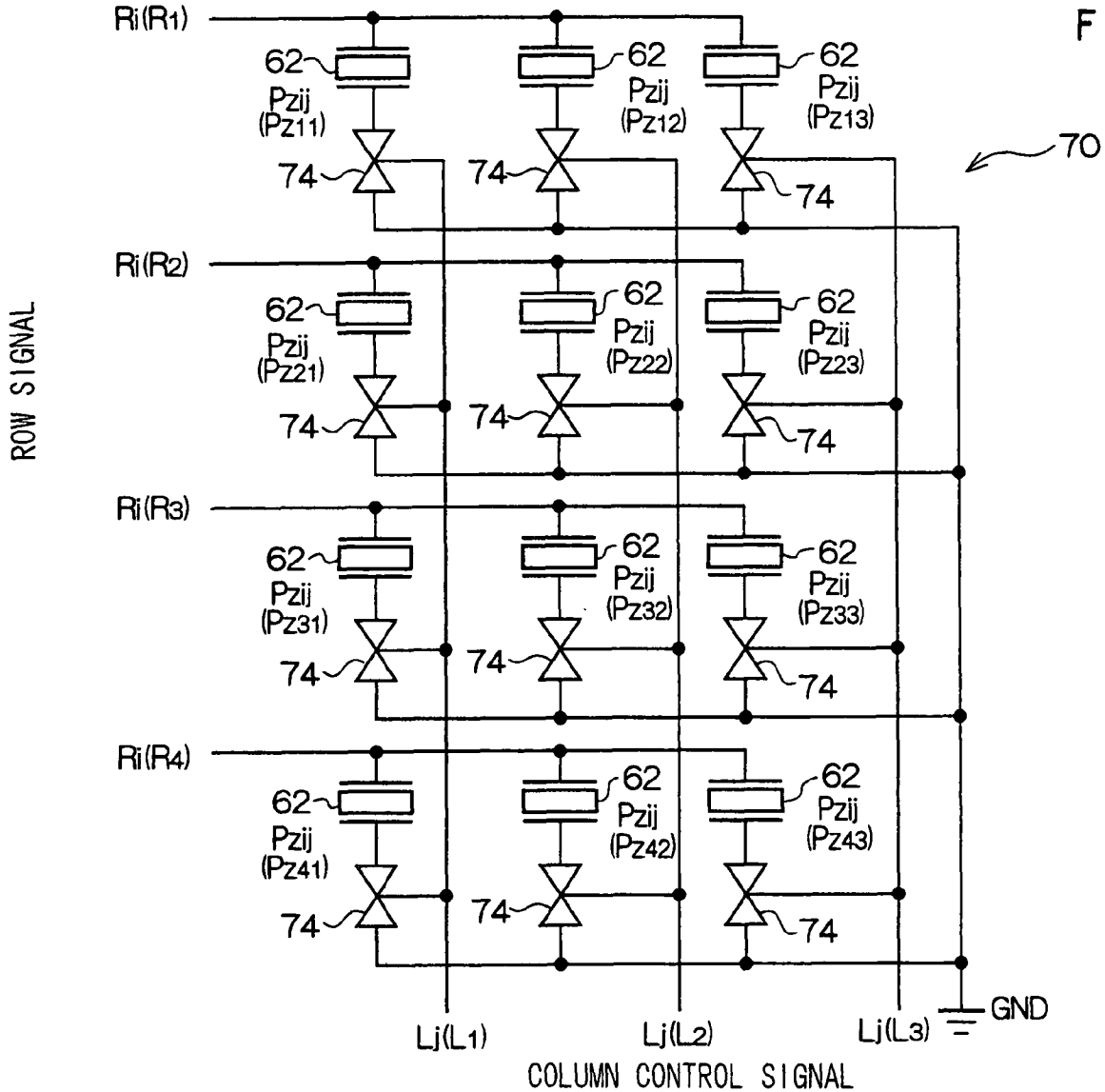
FIG. 4B is a schematic circuit diagram of a matrix driving circuit equivalent to FIG. 4A.

FIGS. 4A and 4B show the schematic configuration of the matrix driving circuit 70 used for this embodiment. Here, the 12 pieces of the piezoelectric elements 62 are shown as the piezoelectric elements $Pz_{ij}$ (i=1 to m, j=1 to n, here, i=1 to 4, j=1 to 3). Hereinafter, for indicating a specific piezoelectric element 62, it is shown as the piezoelectric element $Pz_{ij}$, or the like. Moreover, FIGS. 4A and 4B show the same circuit. In FIG. 4A, the piezoelectric elements 62 are arranged linearly, and in FIG. 4B, the piezoelectric elements 62 are arranged in the matrix system (matrix manner).

In the matrix driving circuit 70, each of the piezoelectric elements 62 (piezoelectric elements $Pz_{ij}$) has a gate switch 74 so that one of the electrodes of the piezoelectric elements $Pz_{ij}$ can be grounded (GND) by switching on the gate switch 74.

Moreover, to the matrix driving circuit 70, the row signals $R_i$ ($R_1$, $R_2$, $R_3$, $R_4$) and the column control signals $L_j$ ($L_1$, $L_2$, $L_3$) are to be inputted.

In the matrix driving circuit 70, the same row signal $R_i$ is inputted to the piezoelectric elements $Pz_{ij}$ in the same row, and moreover, the same column control signal $L_i$ is inputted to the gate switches 74 for the piezoelectric element $Pz_{ij}$ in the same column.

That is, the row signal $R_1$ is inputted to the piezoelectric elements $Pz_{11}$, $Pz_{12}$, $Pz_{13}$, the row signal $R_2$ to the piezoelectric elements $Pz_{21}$, $Pz_{22}$, $Pz_{23}$, the row signal $R_3$ to the piezoelectric elements $Pz_{31}$, $Pz_{32}$, $Pz_{33}$, and the row signal $R_4$ to the piezoelectric elements $Pz_{41}$, $Pz_{42}$, $Pz_{43}$. Moreover, the column control signal $L_1$ is inputted as the operation signal to the gate switches 74 of the piezoelectric elements $Pz_{11}$, $Pz_{21}$, $Pz_{31}$, $Pz_{41}$, the column control signal $L_2$ is inputted as the operation signal to the gate switches 74 of the piezoelectric elements $Pz_{12}$, $Pz_{22}$, $Pz_{32}$, $Pz_{42}$, and the column control signal $L_3$ is inputted as the operation signal to the gate switches 74 of the piezoelectric elements $Pz_{13}$, $Pz_{23}$, $Pz_{33}$, $Pz_{43}$.

Thereby, in the matrix driving circuit 70, the piezoelectric elements $Pz_{ij}$ are connected like a matrix (matrix system) so as to enable the matrix driving of the piezoelectric elements $Pz_{ij}$ by the row signal $R_i$ and the column control signal $L_j$.

Figure 5:
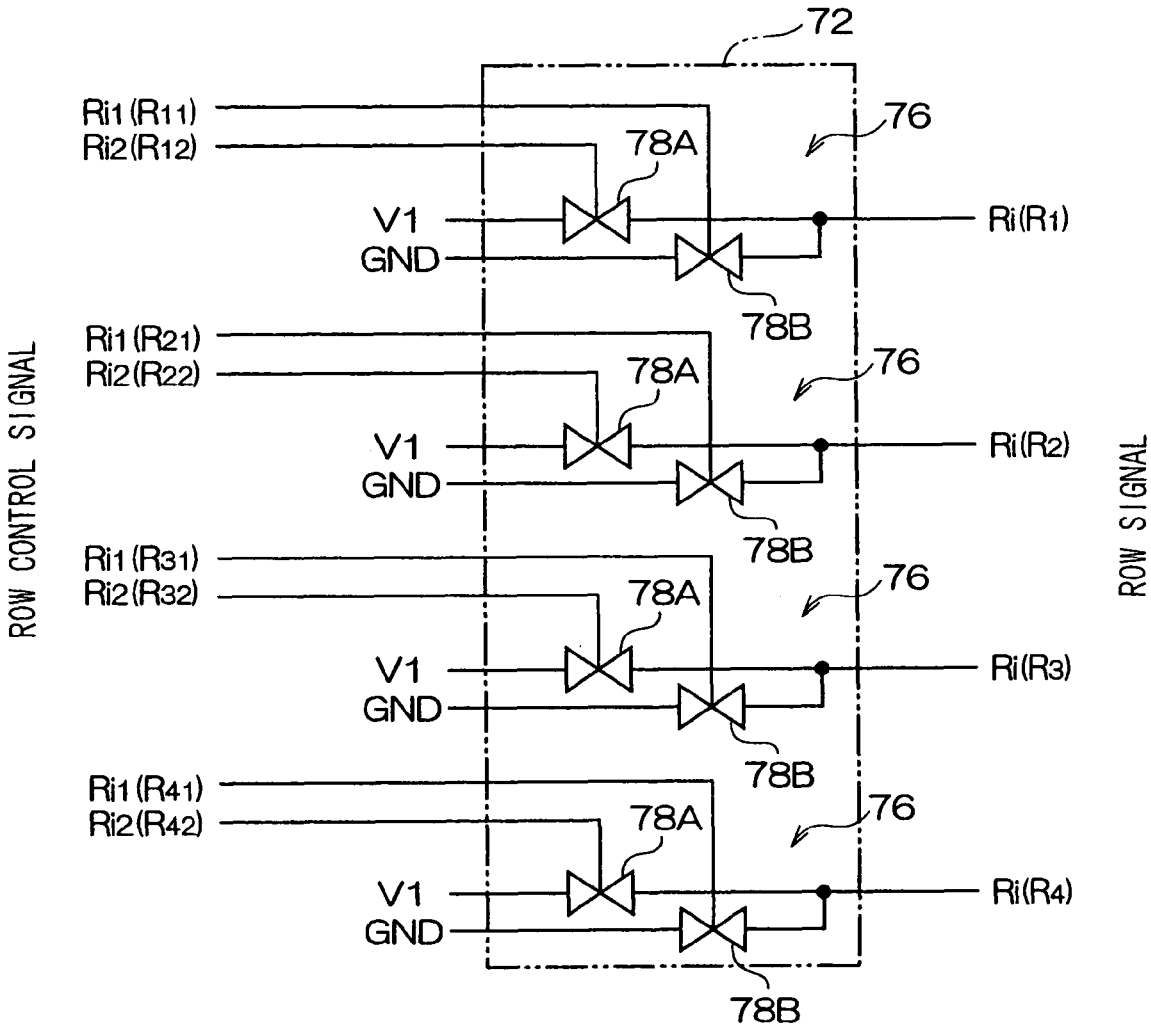
FIG. 5 is a schematic circuit diagram showing an example of a row control circuit according to the first embodiment.

On the other hand, FIG. 5 shows an example of the row control circuit 72. In the row control circuit 72, a switch circuit 76 is formed per row signal $R_i$ to be inputted to the matrix drive circuit 70. Each of the switch circuits 76 are formed with two gate switches 78A and 78B.

The gate switches 78A and 78B includes one of the terminals as the input terminal and the other terminal as the output terminal. To the gate switch 78A, a voltage $V_1$ for driving the piezoelectric element $Pz_{ij}$ is inputted to the input terminal thereof In the gate switch 78B, the input terminal is grounded (GND).

Thereby, in the switch circuit 76, by switching on the gate switch 78A, the voltage $V_1$ is outputted as the row signal $R_i$, and by switching on the gate switch 78B, 0 v (GND) is outputted as the row signal $R_i$. Moreover, the switch circuit 78 provides the non signal state opening the output side as the row signal $R_i$ by switching off the gate switches 78A, 78B.

In the switch circuits 76, the row control signals $R_{i1}$, $R_{i2}$ are to be imputed to the input terminals of the gate switches 78A, 78B so that the switch circuits 76 have the gate switches 78A, 78B switched on/off by the row control signals $R_{i1}$, $R_{i2}$ so as to output the voltage $V_1$, GND and open (non signal) as the row signal $R_i$. The row controls signals $R_{i1}$, $R_{i2}$ are pulse signals not to be switched on at the same time.

According to the matrix driving circuit 70 shown in FIGS. 4A and 4B, by switching on the gate switch 74 by the column control signal $L_j$ when the voltage $V_1$ is inputted as the row signal $R_i$, the driving voltage $V_1$ is applied to the piezoelectric elements $Pz_{ij}$ (piezoelectric elements 62) for charging the piezoelectric elements $Pz_{ij}$, and by switching on the gate switch 74 when 0 v (GND) is inputted as the row signal $R_i$, the applied voltage is 0 v (GND).

Moreover, in the matrix driving circuit 70, in a state in which the piezoelectric elements $Pz_{ij}$ is charged to the voltage $V_1$ or in a GND state (discharged state), by switching off the gate switch 74 or by switching off the gate switches 78A, 78B of the row control circuit 72 (see FIG. 5) so as to be in the open state, the voltage $V_1$ charged state or the GND potential state is maintained.

That is, in the matrix driving circuit 70, the applied voltage for the piezoelectric elements $Pz_{ij}$ can be changed among "from 0 v (GND) to the voltage $V_1$", "maintain the voltage $V_1$", "from the voltage $V_1$ to 0 v (GND, discharge)" and "maintain 0 v (GND)" by the row signal $R_i$ and the column control signal $L_j$. Thereby, the state equivalent to the voltage change based on the driving waveform shown in FIG. 3 can be generated between the terminals of the piezoelectric elements $Pz_{ij}$.

Moreover, in the matrix driving circuit 70, according to the combination of the row signals $R_i$ and the column control signal $L_j$, for each of m×n (here, 4×3) pieces of the piezoelectric elements 62, change of the driving voltage (applied voltage) from GND (0 v) to the voltage $V_1$ (charge), and change from the voltage $V_1$ to GND (0 v) (discharge) can be enabled.

FIG. 6 shows the state change of each piezoelectric element $Pz_{ij}$ according to the row signal $R_i$ and the column control signal $L_j$ in the matrix driving circuit 70. In FIG. 6, the open state (non row signal $R_i$) is shown by "-".

That is, by changing over the row signals $R_1$ to $R_4$ while inputting the pulse signals to be switched on successively into the matrix driving circuit 70 as the column control signals $L_j$, the voltage applied state to the piezoelectric elements $Pz_{ij}$ can be switched individually.

Thereby, by inputting the row signals $R_i$ for driving each piezoelectric element $Pz_{ij}$ according to the image data, that is, the row control signals $R_{i1}$, $R_{i2}$ to the row control circuit 72, the image recording operation can be enabled according to the image data.

Here, with reference to FIGS. 7A, 7B, 7C, an example of the driving signal for the piezoelectric elements 62 ($Pz_{ij}$) with respect to the input signal of the matrix driving circuit 70 used for the first embodiment will be explained.

Figure 7A:
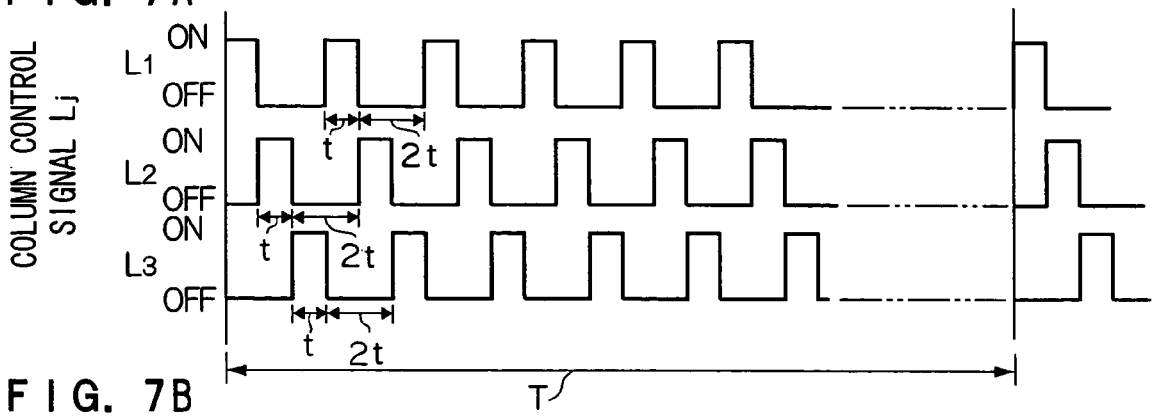
FIG. 7A is a timing chart showing an example of the column control signal.

FIG. 7A shows an example of the column control signals $L_j$ ($L_1$ to $L_3$) to be inputted into the matrix driving circuit 70. As the column control signal $L_j$, for example, a pulse signal with a pulse width (on time) t of 1 μsec is used so that the pulse signals are to be switched on/off successively.

At this time, even in the case the pulse width t is 3 μsec, when the printing operation is carried out using 4×3 pieces of the piezoelectric elements 62, the image recording can be carried out by the resolution of 600 dpi or higher. The pulse width t is set by taking into consideration of the charging characteristics and the discharging characteristics of the piezoelectric elements $Pz_{ij}$ so as to provide a time sufficient for charging or discharging the piezoelectric elements $Pz_{ij}$. Moreover, the column control signals $L_1$, $L_2$, $L_3$ have the on/off timing controlled so as not to have the on state simultaneously.

The controller 60 grounds (GND) the piezoelectric elements $Pz_{ij}$ by the column control signal $L_j$ and the row signal $R_i$ to be inputted to the matrix driving circuit 70 at the starting of each printing cycle T such that the terminal voltage (applied voltage) becomes 0 v. The row controls signals $R_{i1}$, $R_{i2}$ and the column control signal $L_j$ to be outputted form the driving control circuit 66 are controlled so as to output the driving waveform with this state provided as the initial state.

On the other hand, the row controls signals $R_{i1}$, $R_{i2}$ are outputted synchronously with the column control signal $L_j$ as well as based on the image data to be printed.

Figure 7B:
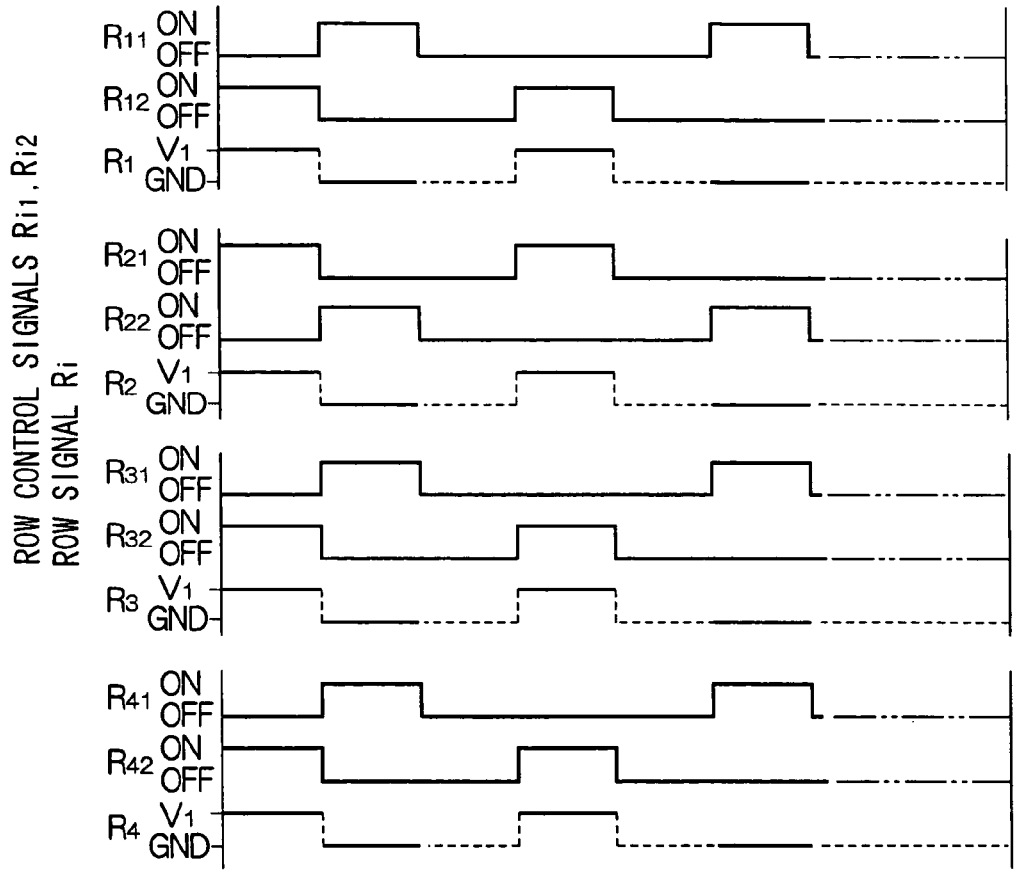
FIG. 7B is a timing chart showing an example of a row control signal and a row signal according to the row control signal.
Figure 7C:
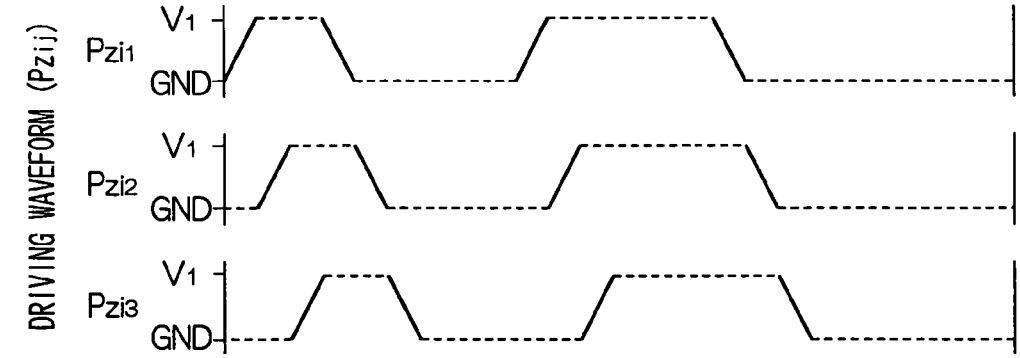
FIG. 7C is a timing chart showing the change of the terminal voltage of the piezoelectric elements (driving waveform) based on FIGS. 7A and 7B.

Here, at the time of driving the piezoelectric elements $Pz_{i1}$ ($Pz_{11}$, $Pz_{21}$, $Pz_{31}$, $Pz_{41}$) as shown in FIG. 7C, by outputting the row control signals $R_{i1}$, $R_{i2}$ such that the row signal $R_i$ is set as the voltage $V_1$ at the timing of switching on the row control signal $L_1$ as shown in FIG. 7B, the piezoelectric elements $Pz_{ij}$ are charged to the voltage $V_1$. Thereafter, by outputting the row control signals $R_{i1}$, $R_{i2}$ so as to switch off the row signal $R_i$ (open) at the timing of switching off the column control signal $L_1$, the terminal voltage (applied voltage) of the piezoelectric elements $Pz_{ij}$ is maintained at the voltage $V_1$.

Moreover, at the time of lowering the applied voltage of the piezoelectric elements $Pz_{ij}$ from the voltage $V_1$ to 0 v, by outputting the row control signals $R_{i1}$, $R_{i2}$ such that the row signal $R_i$ is set (changed) as 0 v (GND) at the timing of switching on the column control signal $L_1$, the piezoelectric elements $Pz_{ij}$ are discharged, and thereafter, by outputting the row control signals $R_{i1}$, $R_{i2}$ so as to switch off the row signal $R_i$ (open) at the timing of switching off the column control signal $L_1$, the terminal voltage (applied voltage) of the piezoelectric elements $Pz_{ij}$ is maintained at 0 v (GND).

Thereby, a driving waveform of changing from GND to voltage $V_1$ to GND can be obtained with respect to $Pz_{i1}$ in the piezoelectric elements $Pz_{ij}$. That is, the piezoelectric element $Pz_{i1}$ is charged by the row signal $R_i$ being set as the voltage $V_1$ at the time of switching on the column control signal $L_1$, and the state charged to the voltage $V_1$ can be maintained by switching off the column control signal $L_1$ and switching off the row control signal $R_i$.

By the row control signal $R_i$ being set as GND at the time of switching on the column control signal $L_1$ in this state, the piezoelectric element $Pz_{i1}$ is discharged such that the terminal voltage becomes 0 v (GND).

At the time, the time maintained at the voltage $V_1$ can be selected according to the GND timing of the row signal $R_i$.

Moreover, in the same manner, also with respect to the piezoelectric elements $Pz_{i2}$ ($Pz_{12}$, $Pz_{22}$, $Pz_{32}$, $Pz_{42}$) and the piezoelectric elements $Pz_{i3}$ ($Pz_{13}$, $Pz_{23}$, $Pz_{33}$, $Pz_{43}$), the terminal voltage can be changed from GND to voltage $V_1$ to GND.

In the piezoelectric elements $Pz_{ij}$, by repeating change of the terminal voltage at a predetermined timing, a state equivalent to a state in which the driving waveform according to the terminal voltage change is applied can be obtained so that ink liquid droplets are ejected from the nozzle of the liquid droplet ejector 64 according to the driving waveform.

Figure 8A:
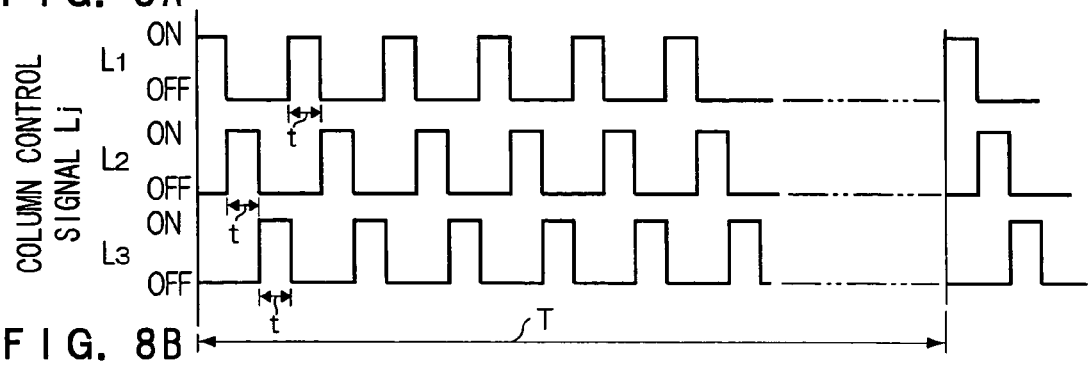
FIG. 8A is a timing chart showing an example of the column control signal.
Figure 8B:
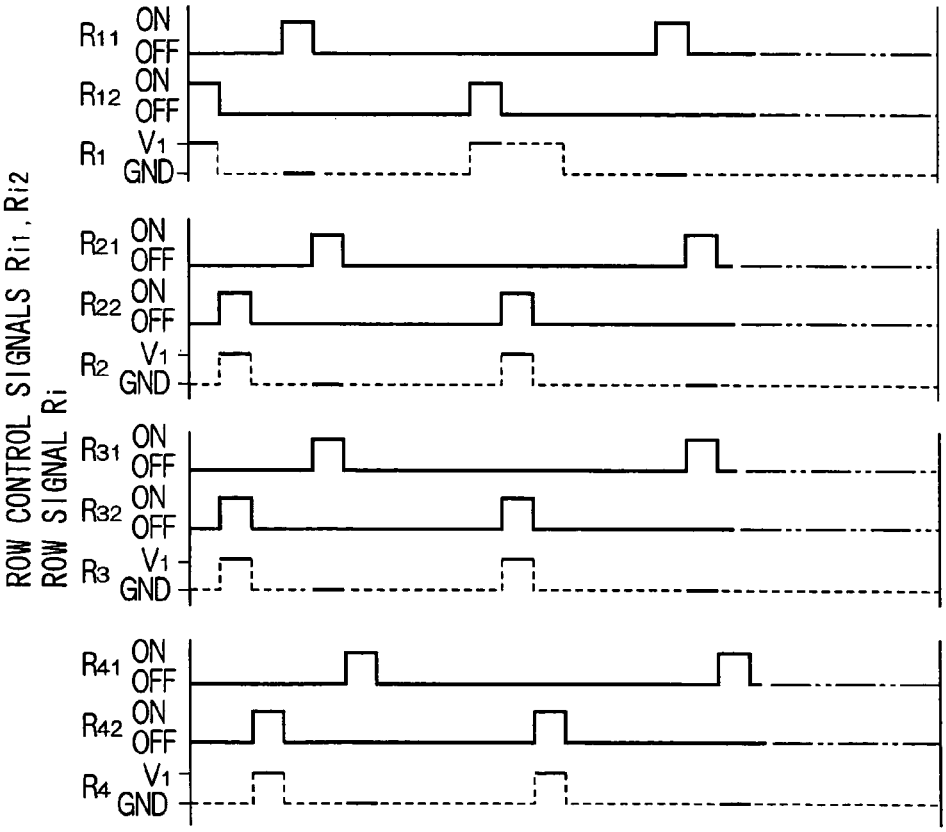
FIG. 8B is a timing chart showing an example of a row control signal and a row signal according to the row control signal.
Figure 8C:
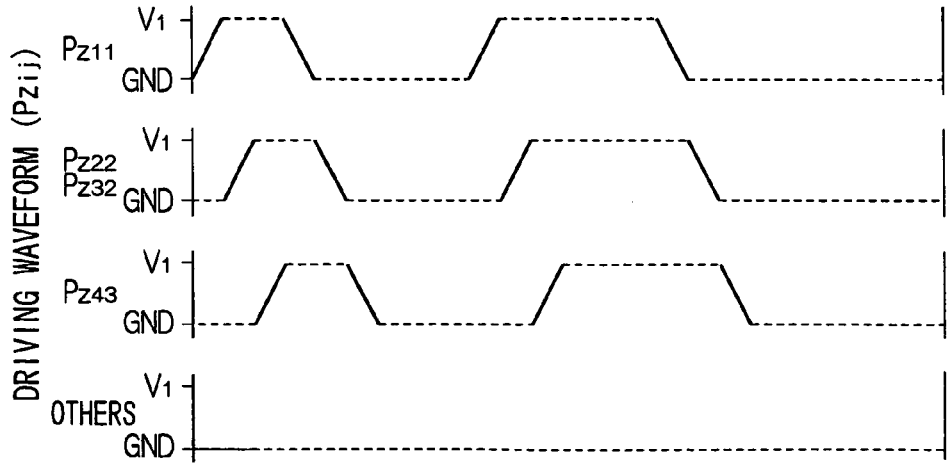
FIG. 8C is a timing chart showing the change of the terminal voltage of the piezoelectric elements (driving waveform) based on FIGS. 8A and 8B.

On the other hand, as a specific example, FIGS. 8A, 8B and 8C show the column control signal $L_j$ and the row control signals $R_{i1}$, $R_{i2}$ (row control signal $R_i$) at the time of applying the driving waveform individually to the piezoelectric element $Pz_{11}$, Piezoelectric element $Pz_{22}$, the piezoelectric element $Pz_{32}$, and the piezoelectric element $Pz_{43}$ among the piezoelectric elements $Pz_{ij}$ and stopping the drive of the other piezoelectric elements $Pz_{ij}$ (stopping the application of the driving waveform).

Moreover, FIG. 9 shows the row signal $R_i$ with respect to the column control signal $L_j$ at the time of obtaining the driving waveform of FIG. 8C and the state change of the voltage to be applied to the piezoelectric elements $Pz_{ij}$ based on the column control signal $L_j$ and the row signal R& at this time.

Also at this time, for example, at the time of changing the voltage applied to the piezoelectric elements $Pz_{11}$ from GND to voltage $V_1$ to GND, the row control signal $R_{11}$ is switched off and the row control signal $R_{12}$ is switched on such that the row signal $R_1$ is set as the voltage $V_1$ at the timing of switching on the column control signal $L_1$. Thereby, the voltage applied to the piezoelectric element $Pz_{11}$ is raised from 0 v (GND) to the voltage $V_1$.

Moreover, by switching on the row control signal $R_{11}$ and switching off the row control signal $R_{12}$ such that the row signal $R_1$ is set as GND at the timing of switching on the column control signal $L_1$ in a state in which the piezoelectric element $Pz_{11}$ is charged to the voltage $V_1$, the piezoelectric element $Pz_{11}$ is discharged so that the applied voltage can be lowered from the voltage $V_1$ to 0 v (GND).

By repetition of changing of the applied voltage of the piezoelectric elements $Pz_{ij}$ from GND to voltage $V_1$ to GND, the liquid droplet ejector 64 ejects the ink liquid droplets. Moreover, according to the number of the driving waveforms applied in the printing cycle T, the ejection droplet amount for forming one dot is adjusted.

Accordingly, by using the matrix driving circuit 70, (m×n) pieces of the piezoelectric elements 62 can be driven individually as well as the droplet amount to be ejected from the corresponding liquid droplet ejector 64 can be controlled at the same time.

That is, by carrying out the drive of the piezoelectric elements $Pz_{ij}$ using only parts of the rise portion and the fall portion of the original driving waveform, the piezoelectric elements $Pz_{ij}$ of one block of m×n pieces can be driven individually by the matrix driving circuit 70.

Moreover, in the first embodiment, at the time of driving (m×n) pieces of the piezoelectric elements 62, m pieces of the column controlling wirings and (n×2) pieces of the row controlling wirings are needed for the head unit 32. However, compared with the case of inputting the driving waveform and the on/off signal for the gate switch 74 for each piezoelectric element 62, the number of the required wirings can be smaller. Moreover, the driving circuit 68 provided at the head unit 32 can be simplified and the number of the assembly steps can be reduced.

Figure 10B:
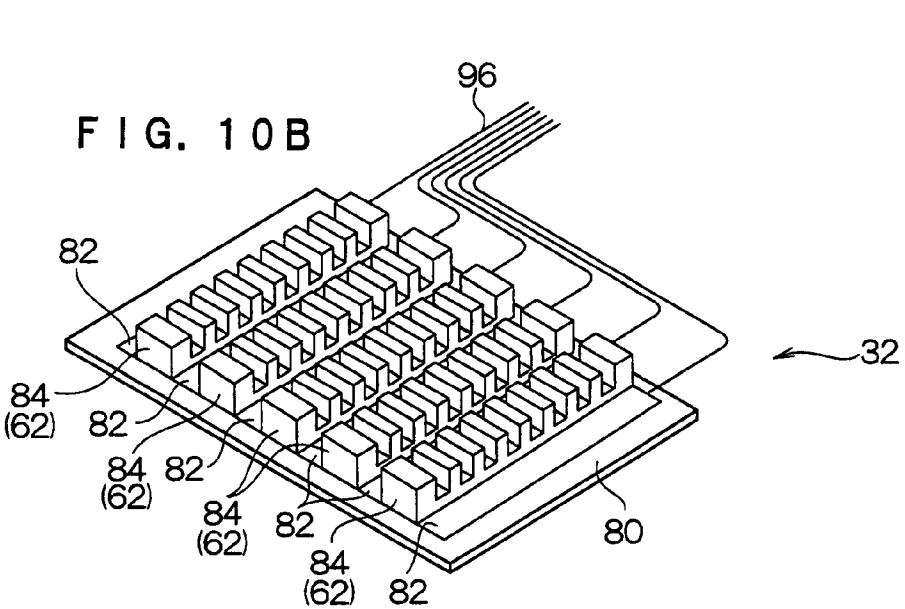
FIGS. 10A, 10B, 10C are schematic diagrams showing in this order the flow of the production process for a head unit.
Figure 10C:
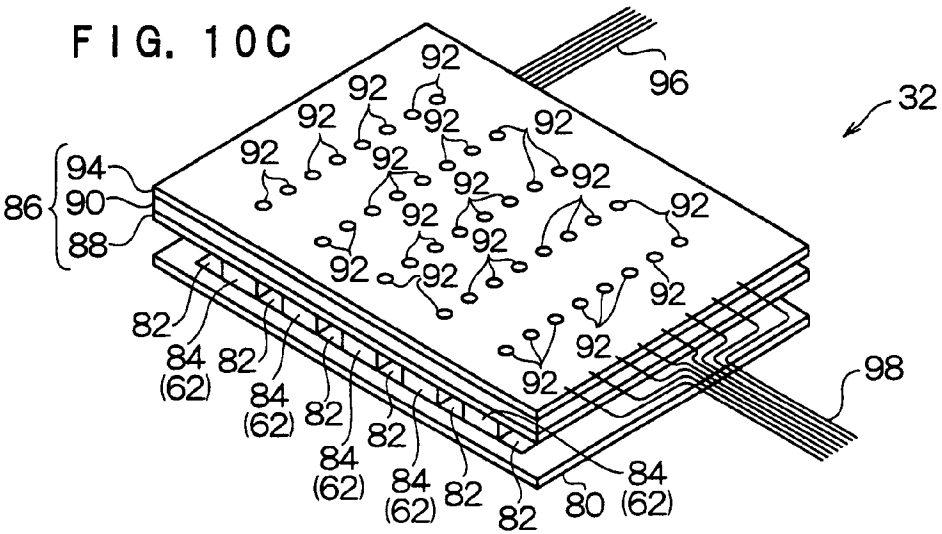
Figure 10A:
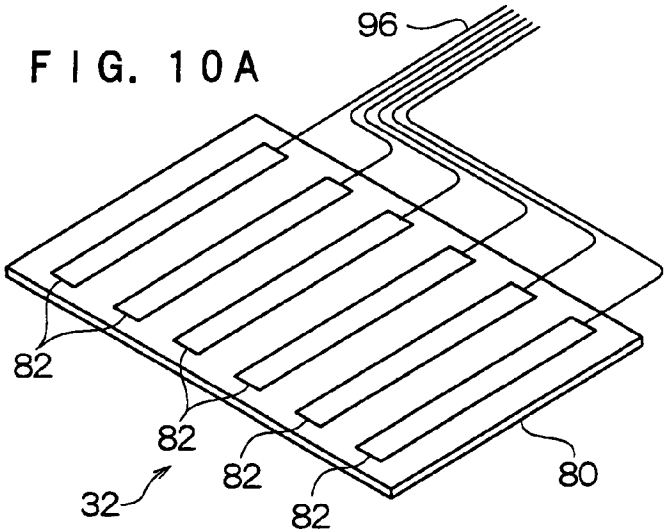

FIGS. 10A to 10C schematically show the manufacture-process for the head unit 32 according to the first embodiment. Although one module in a case of forming the head unit 32 including plural divided head unit modules is shown to explain here, the shape and the nozzle arrangement of the head unit 32 for applying the present invention is not limited thereby. Moreover, as the material for each member, a known material can be used, and thus detailed explanation is omitted here.

When manufacturing the head unit 32, first, as shown in FIG 10A, a thin film semiconductor circuit 82 is formed on an insulating substrate 80 by the decompression CVD method, or the like.

Next, a piezoelectric element modules 84 capable of forming the plural piezoelectric elements 62 are mounted on the insulating substrate 80. At this time, the piezoelectric element module 84 is connected electrically with the thin film semiconductor circuit 82 formed already on the insulating substrate 80 by arranging and reflowing spherical solders between the insulating substrate 80 and the piezoelectric element module 84.

Thereafter, with respect to the piezoelectric element module 84, by polishing the end face of each piezoelectric element 62 to be mounted, it is aligned. Moreover, by dicing the end face of the polished piezoelectric elements 62, the piezoelectric elements 62 are individualized corresponding to each pressure generating chamber of the liquid droplet module 64 (not shown) as the smallest constituent unit.

Next, as shown in FIG. 10C, the head main body 86 is mounted. In the head main body 86, a vibrating plate 88, a pressure-chamber forming member 90 with a pressure generating chamber for each liquid droplet ejector 64 formed therein, and a nozzle plate 94 with a nozzle 92 corresponding to the pressure generating chamber (liquid droplet ejector 64) formed thereon are laminated.

At the time of manufacturing the head unit 32 accordingly, as shown in FIG. 10A, column controlling wirings 96 are connected to the insulating substrate 80. Moreover, by connecting row controlling wirings 98 to the vibrating plate 88, a head main body 86 is manufactured. As the wirings 96 and 98, a FFC (Flexible flat cable) or the like is used.

In the head array 32 manufactured accordingly, the wirings 96 connected to the insulating substrate 80 can be provided commonly for each column by forming the matrix driving circuit 70 with the thin film semiconductor circuit 82. Moreover, the wirings 68 connected to the vibrating plate 88 can be provided commonly for each row.

Thereby, the wirings connected with the head unit 32 can be simplified so that reducing of the number of the parts, improvement of the production yield and the production cost reduction can be achieved.

The row control circuit 72 is provided in the head unit 32 in the first embodiment, by providing the row control circuit 72 in the driving control circuit, the wirings between the head unit 32 and the drive control circuit 66 can be simplified.

Second Embodiment

Next, the second embodiment of the present invention will be explained. Since the basic configuration of the second embodiment is same as the above-mentioned first embodiment, in the second embodiment, the same numerals are applied to the same parts as those of the first embodiment, and explanation thereof is omitted.

According to the above-mentioned first embodiment, the piezoelectric elements 62 (piezoelectric elements $Pz_{ij}$) are driven by the driving waveform of the voltage $V_1$, however, in the second embodiment, they are driven by the driving waveform to be changed in 3 levels of 0 v (GND), the voltage $V_1$ and the voltage $V_2$ ($V_2>V_1$).

Figure 11A:
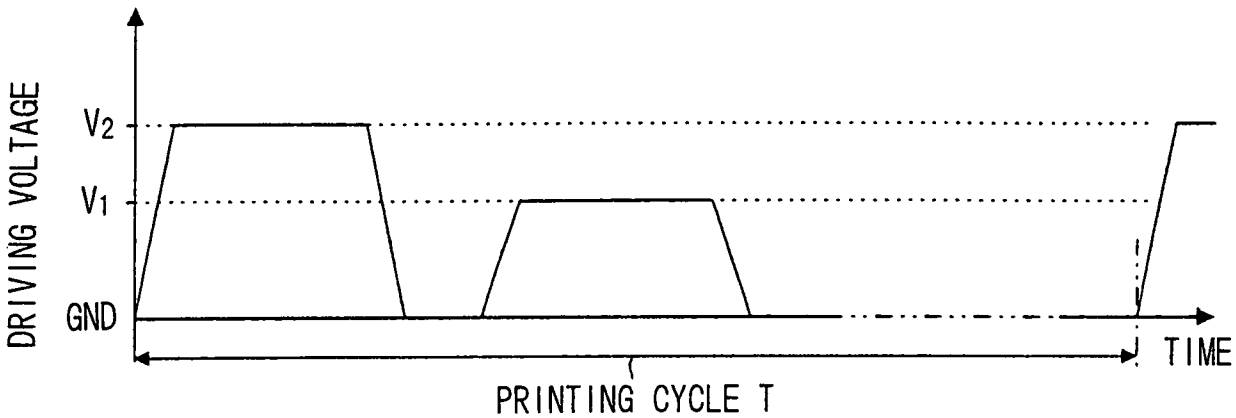
FIGS. 11A and 11B are linear diagrams showing schematically the driving waveforms of the piezoelectric elements according to a second embodiment.
Figure 11B:
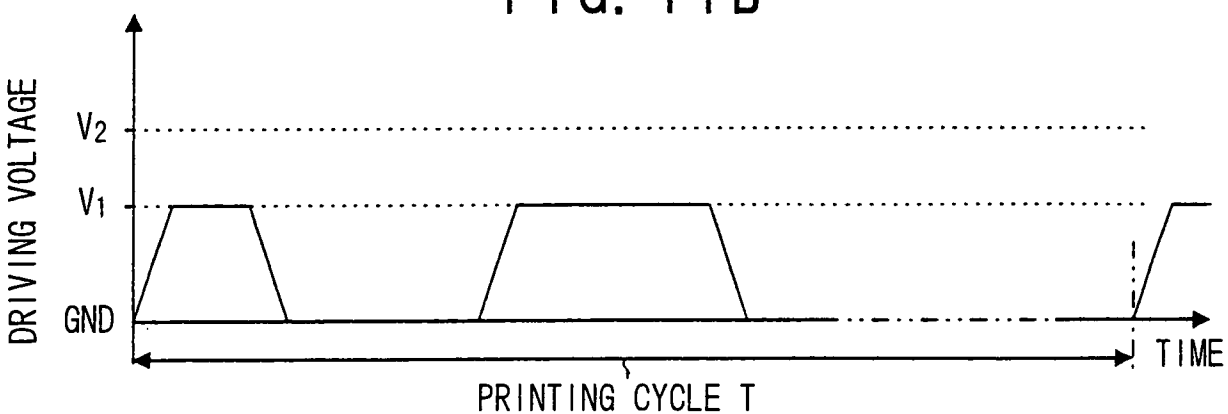

That is, the ejection droplet amount is controlled by driving of the piezoelectric element 62 using the voltage $V_2$ driving waveform and the voltage $V_1$ driving waveform as shown in FIG. 11A, using the voltage $V_1$ driving waveform at the time of being able to drive by the voltages $V_1$ and $V_2$ as shown in FIG. 11B, or the like.

Figure 12:
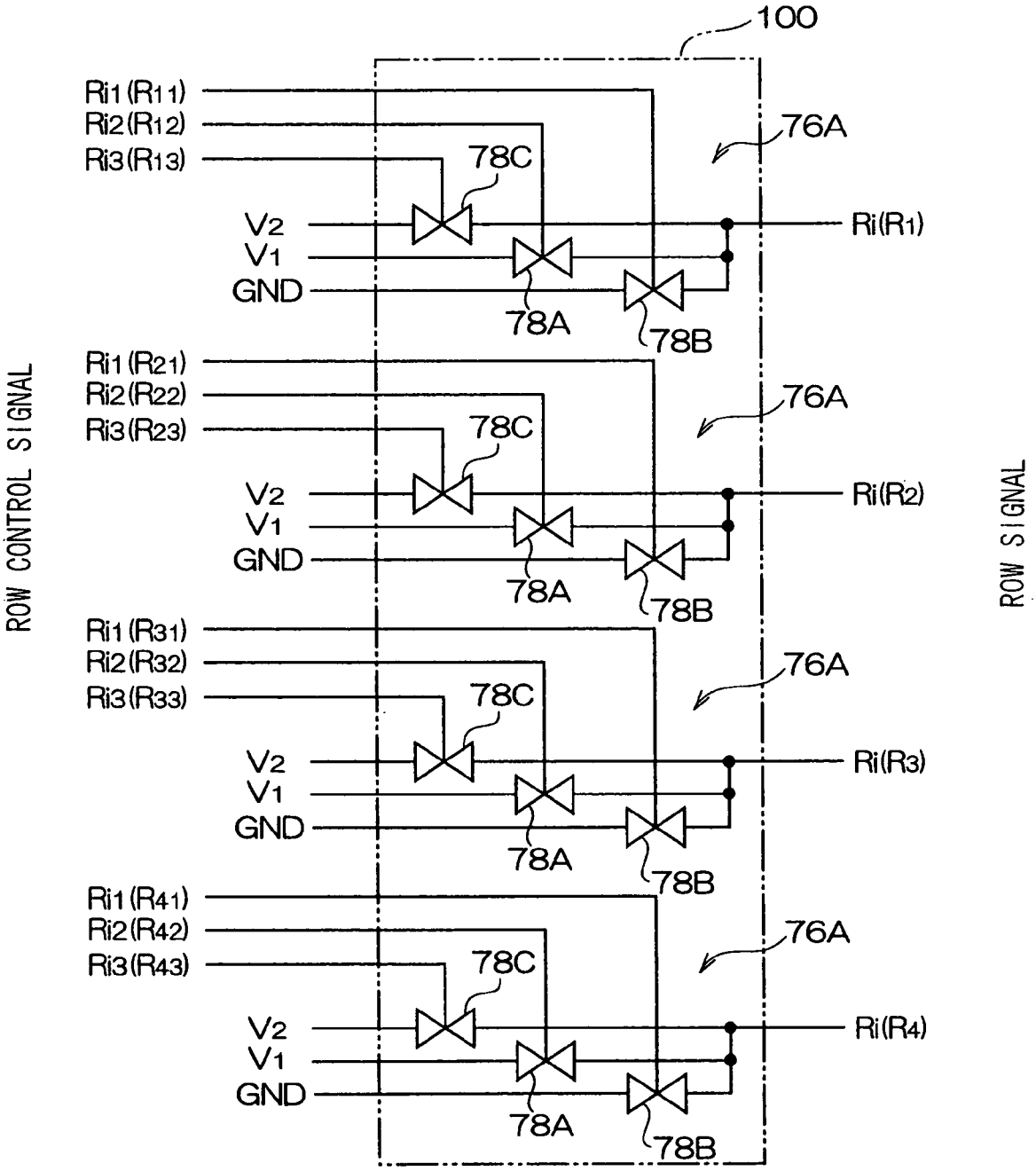
FIG. 12 is a schematic circuit diagram showing an example of a row control circuit according to the second embodiment.

FIG. 12 shows the schematic configuration of the row control circuit 100 used in the second embodiment instead of the row control circuit 72.

To the row control circuit 100, the Voltage $V_1$, GND and the voltage $V_2$ are to be inputted to each switch circuit 76A. The switch circuit 76A in provided with the gate switch 78C for the voltage $V_2$ in addition to the gate switch 78A for the voltage $V_1$ and the gate switch 78B for GND.

Moreover, to each switch circuit 76A, in addition to the operation signals for the gate switches 78A, 78B, an operation signal for the gate switch 78C is to be inputted. Herein, the operation signal for the gate switch 78B is as the row control signal $R_{i1}$, the operation signal for the gate switch 78A is as the row control signal $R_{i2}$ and the operation signal for the gate switch 78C is as the row control signal $R_{i3}$.

Thereby, in the switch circuit 76A, the row signal $R_i$ for the voltage $V_2$, the voltage $V_1$, GND or open is outputted based on the row control signals $R_{i1}$ to $R_{i3}$. At the time, in the drive control circuit 66, the row control signals $R_{i1}$ to $R_{i3}$ are outputted according to the column control signal $L_j$ as the synchronous signal and the image data.

Figure 13A:
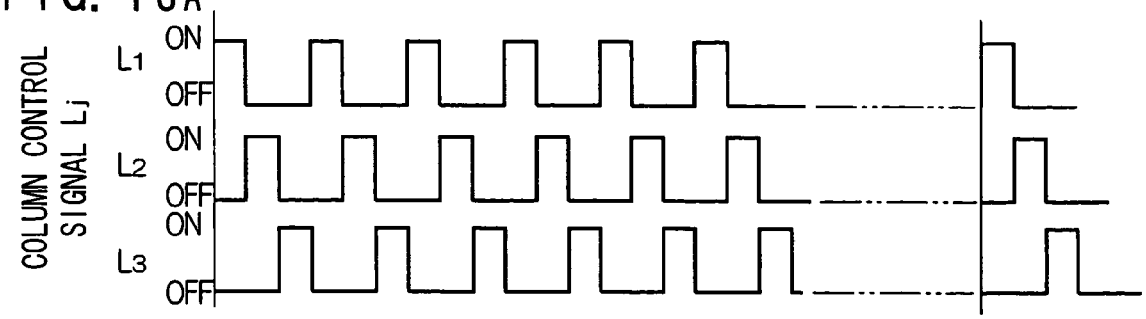
FIG. 13A is a timing chart showing an example of the column control signal.
Figure 15:
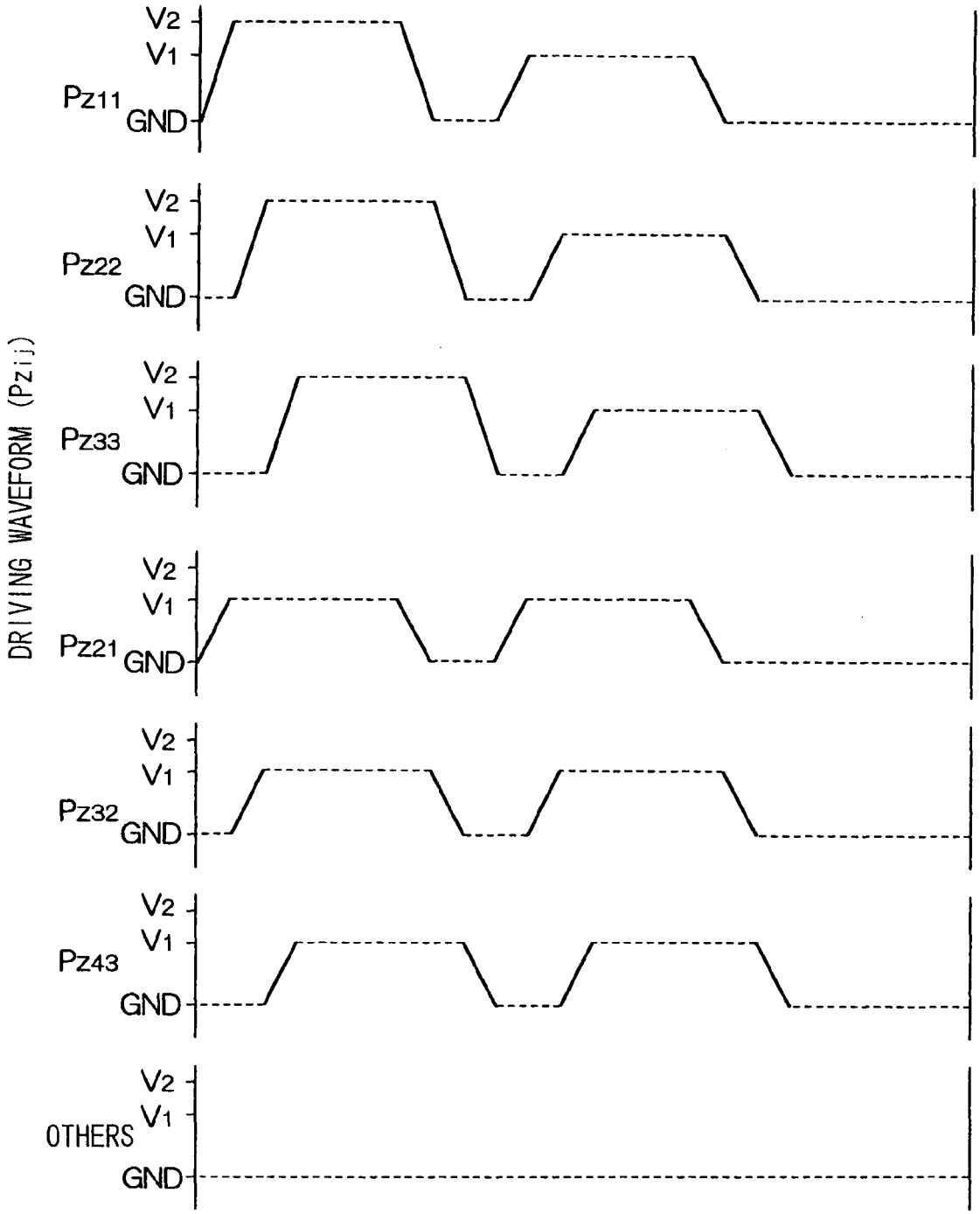
FIG. 15 is a chart showing the applied voltage state of the piezoelectric elements according to the column control signal and the row signal equivalent to FIGS. 13A, 13B and 14.

FIGS. 13A to 15 show an example of the drive of the piezoelectric elements $Pz_{ij}$ when using such row control circuit 100 and matrix driving circuit 70. In FIGS. 13A to 15, the driving waveform shown in FIG. 15 is outputted. FIGS. 13A and 13B show the column control signal $L_j$ and the row signal $R_i$ based on the column control signals $R_{i1}$ to $R_{i3}$ are shown, and FIG. 14 shows the voltage application state to each piezoelectric element 62 ($Pz_{ij}$) based on the column control signal $L_j$ and the row signal $R_i$ of FIGS. 13A and 13B.

Figure 13B:
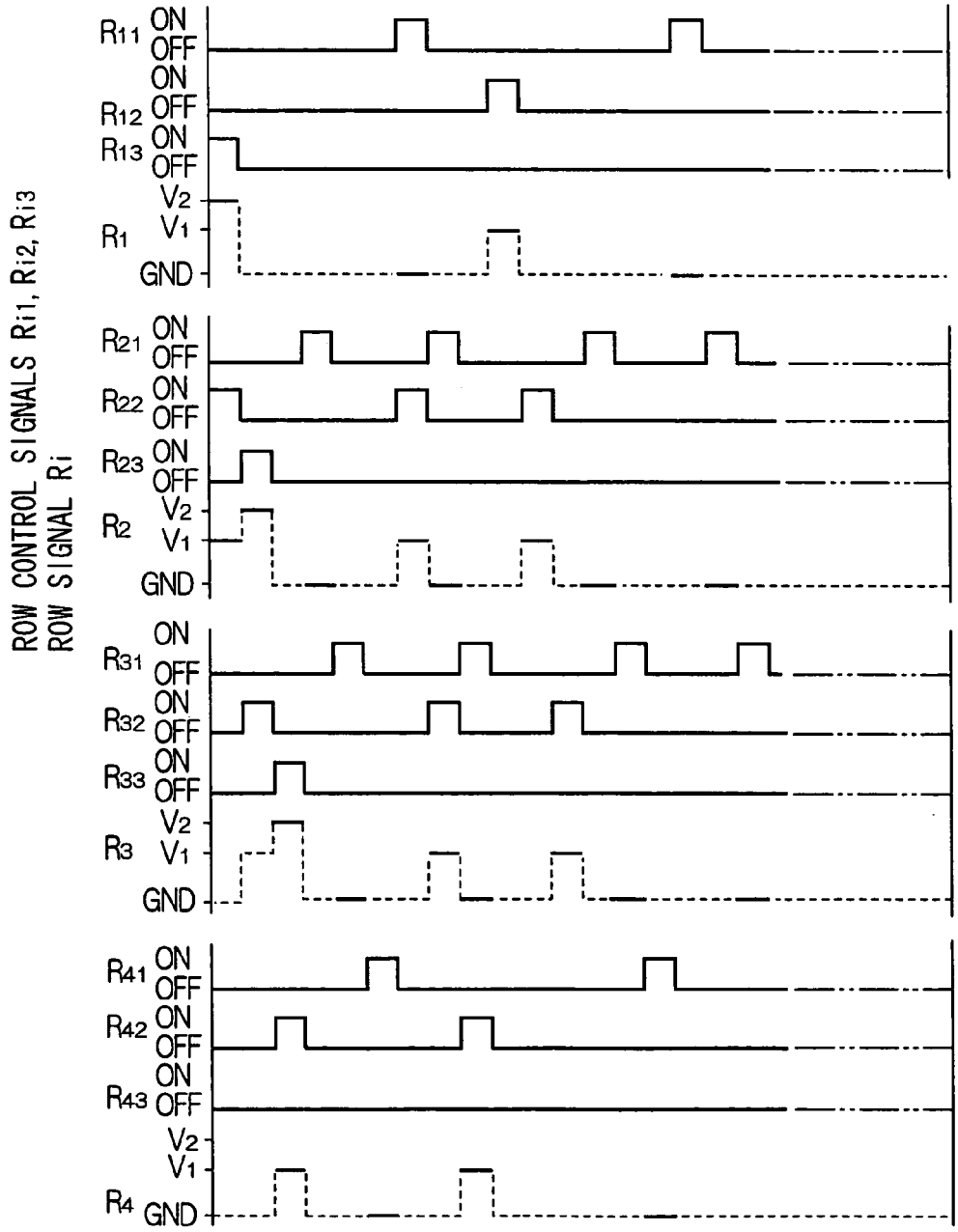
FIG. 13B is a timing chart showing an example of a row control signal and a row signal according to the row control signal.

As shown in FIGS. 13A and 13B, the column control signal $L_j$ switches on the column control signals $L_1$, $L_2$, $L_3$ in that order by a predetermined pulse width t. At the time of starting the printing operation, the drive control circuit 66 grounds (GND) the piezoelectric elements $Pz_{ij}$ so as to have the terminal voltage as 0 v, and then starts the output of the row control signals $R_{i1}$ to $R_{i3}$ (row signal $R_i$) and the column control signal $L_j$.

Here, at the time of raising the applied voltage to the piezoelectric elements $Pz_{11}$ from 0 v (GND) to the voltage $V_2$, the voltage $V_2$ is generated as the row signal $R_1$ according to the timing of switching on the column control signal $L_1$. That is, the row control signals $R_{11}$, $R_{12}$ are switches off and the row control signal $R_{13}$ is switched on.

Thereby, the voltage $V_2$ is outputted as the row signal $R_1$, and the piezoelectric element $PZ_{11}$ is charged to the voltage $V_2$ due to the column control signal $L_1$ being switched on. By switching off the column control signal $L_1$ and the row control signals $R_{11}$, $R_{12}$, $R_{13}$ in this state, the terminal voltage of the piezoelectric element $Pz_{11}$ is maintained at the voltage $V_2$.

Moreover, by switching off the row control signal $R_{12}$, $R_{13}$ and switching on the row control signal $PZ_{11}$ according to the timing of switching on the column controls signal $L_1$ in the state with in which the terminal voltage is maintained at the voltage $V_2$ so as to ground (GND) the row control signal $R_1$, the terminal voltage of the piezoelectric element $Pz_{11}$ is lowered from the voltage $V_2$ so as to be grounded (GND).

Thereby, the driving waveform to be changing from GND to the voltage $V_2$ to GND can be obtained with respect to the piezoelectric element $Pz_{11}$.

Moreover, at the time of raising the applied voltage to the piezoelectric element $Pz_{11}$ from 0 v (GND) to the voltage $V_1$, the row control signals $R_{11}$, $R_{13}$ are switched off and the row control signal $R_{12}$ is switched on such that the row signal $R_1$ is set as the voltage $V_1$ according to the timing of switching on the column control signal $L_1$.

Thereby, the voltage $V_1$ is outputted as the row signal $R_1$, and since the column control signal $L_1$ is switched on, the voltage $V_1$ is applied to the piezoelectric element $Pz_{11}$ so as to charge the same and to raise the terminal voltage to the voltage $V_1$. By switching off the column control signal $L_1$ and the row control signals $R_{11}$, $R_{12}$, $R_{13}$ in this state, the terminal voltage is maintained at the voltage $V_1$ in the piezoelectric element $Pz_{11}$. Furthermore, by grounding (GND) the row signal $R_1$ by switching off the row control signals $R_{12}$, $R_{13}$ and switching on the row control signal $R_{11}$ according to the timing of switching on the column control signal $L_1$, the terminal voltage is lowered from the voltage $V_1$ so as to be GND.

Thereby, the driving waveform to be changing from GND to the voltage $V_1$ to GND with respect to the piezoelectric element $Pz_{11}$ can be obtained, and furthermore, in the GND state, by the row control signals $R_{11}$, $R_{12}$, $R_{13}$ being in the off state, the applied voltage to the piezoelectric element $Pz_{11}$ is maintained at 0 V (GND).

The voltage application to the piezoelectric element $Pz_{11}$ can be carried out in the same manner for each of the piezoelectric elements $Pz_{ij}$, and thereby, the applied voltage for each piezoelectric element $Pz_{ij}$ shown in FIG. 15 can be obtained by the row signal $R_j$ (row control signals $R_{i1}$ to $R_{i3}$ shown in FIG. 13B) shown in FIGS. 13B and 14 and the column control signal $L_j$ shown in FIGS. 13A and 14

Thereby, at the time of matrix driving of the piezoelectric elements 62 ($Pz_{ij}$), high gradation can be obtained so as to enable the high quality image recording operation. At the time, since (m×n) pieces of the piezoelectric elements 62 are controlled by the unit of one row and unit of one column, the number of the wirings necessary for the control can be reduced as well as the wirings can be simplified.

On the other hand, according to the first and second embodiments, although a preset constant voltage (voltage $V_1$ or Voltages $V_1$, $V_2$) is applied to the piezoelectric elements. However, instead of the constant voltage, an optionally changed voltage or waveform may be applied as well.

Figure 16:
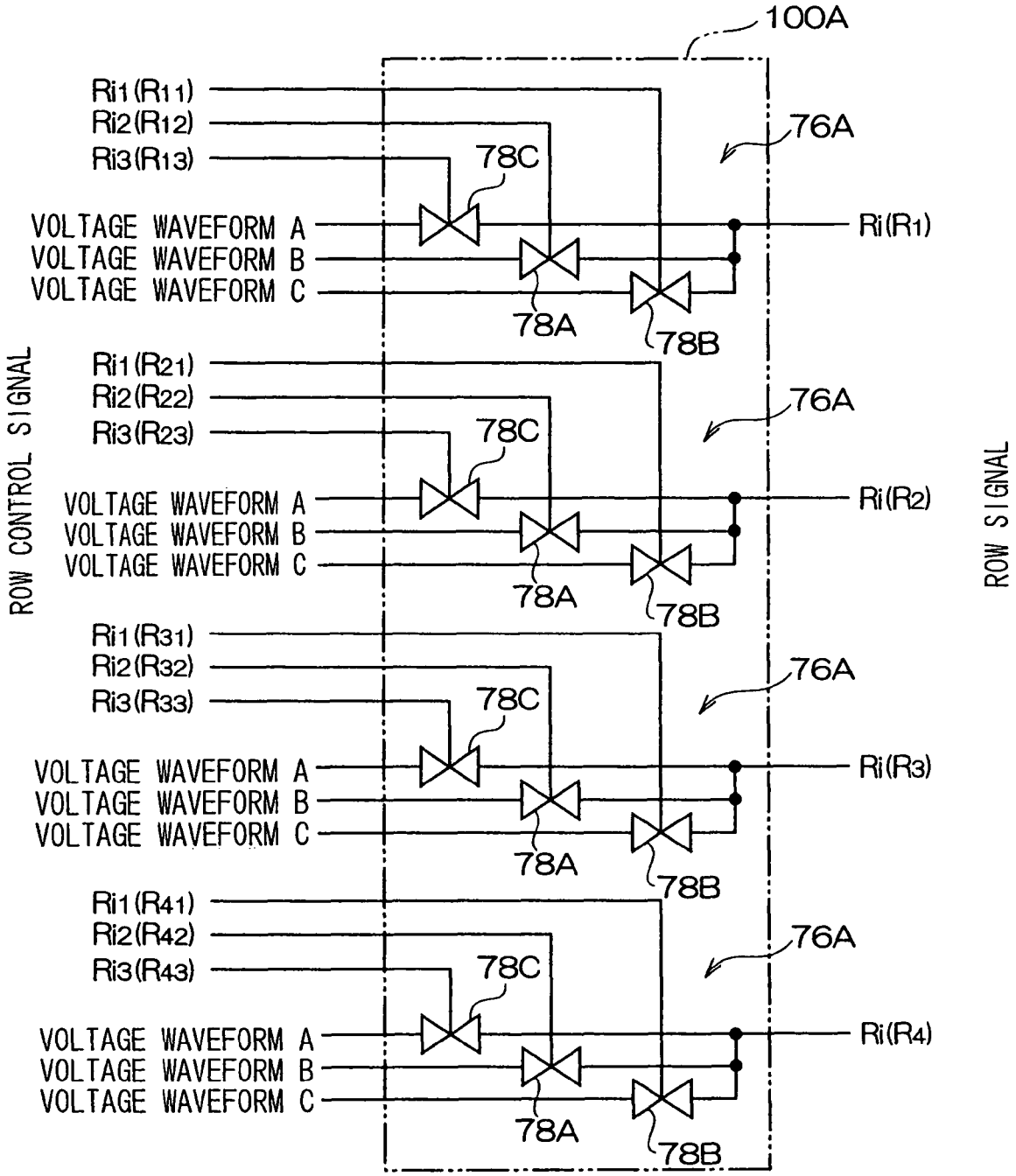
FIG. 16 is a schematic circuit diagram showing another example of a row control circuit according to the present invention.

FIG. 16 shows an example of the row control circuit (here, row control circuit 100A) used at the time of applying a predetermined driving waveform (voltage waveform) via the matrix driving circuit 70.

Although the basic configuration of the row control circuit 100A is same as that of the above-mentioned row control circuit 100, instead of the voltage $V_1$, the voltage $V_2$ and GND, driving waveforms A, B, C are inputted to each switch circuit 76A. As to the driving waveforms A to C, as long as liquid droplet can be ejected form the liquid droplet ejector 64 using the piezoelectric elements 62 ($Pz_{ij}$), an optional voltage or voltage waveform can be used.

Here, for example, by switching on only the row control signal $R_{i1}$, a voltage of the driving waveform A can be applied to the piezoelectric elements $Pz_{ij}$, moreover, by switching on only the row control signal $R_{i2}$, a voltage of the driving waveform B can be applied, and furthermore, by switching on only the row control signal $R_{i3}$, a voltage of the driving waveform C can be applied.

Thereby, since the piezoelectric element 62 ($Pz_{ij}$) drive using an optionally set voltage or voltage waveform (voltage change) can be carried out also at the time of driving m×n pieces of the piezoelectric elements $Pz_{ij}$ as 1 block by the matrix driving circuit 70, the gradation can be improved.

The exemplary embodiments heretofore explained show only an example of the present invention, and thus the configuration of the present invention is not limited thereby. For example, although an example of the ink jet recording device 10 is explained in the embodiments, the present invention is not limited thereto, and it can be used for an ink jet recording device of an optional configuration for ejecting the ink liquid droplets using the piezoelectric elements.

Moreover, although the drive of the piezoelectric elements $Pz_{ij}$ according to the image data is carried out by the row signal $R_i$ (row control signals $R_{i1}$, $R_{i2}$ or the row control signals $R_{i1}$, $R_{i2}$, $R_{i3}$), with the column control signal $L_j$ being as the synchronous signal in the exemplary embodiments, the drive of the piezoelectric elements $Pz_{ij}$ according to the image data may be carried out by the column control signal $L_i$ with the row control signal $R_i$ being as the synchronous signal.

Furthermore, although an example of the ink jet recording device for the image recording by ejecting the ink liquid droplets as a liquid droplet ejecting device is explained in the exemplary embodiments, the present invention is not limited thereto, and thus it can be used for a liquid droplet ejecting device of an optional configuration for ejecting the liquid droplets using the piezoelectric elements such as the piezo element as an actuator.

Furthermore, although an example of the ink jet recording device, in which one or the other of the pair of terminals of the piezoelectric element are each grounded directly or via the switching element, is explained in the exemplary embodiments, the present invention is not limited to the same. The one and the other of the pair of terminals of the piezoelectric element may be each connected to a constant-voltage source (voltage $V_3$) instead of being grounded. A potential of the constant-voltage source can be selected at its option as long as a potential difference between the constant-voltage $V_3$ and the pre-set constant-voltage (the voltage $V_1$ or the voltages $V_1$ and $V_2$) is set so as to be able to eject liquid droplets.

What is claimed is:

1. A method for driving a liquid droplet ejecting head having a plurality of liquid droplet ejectors that eject liquid droplets from nozzles according to respective voltage changes applied to a plurality of piezoelectric elements electrically connected in a matrix including columns of piezoelectric elements and rows of piezoelectric elements, wherein a switching element is provided with respect to each piezoelectric element and capable of grounding one of a pair of terminals of the piezoelectric element, the method comprising:

inputting, per unit of one column of the piezoelectric elements, a column controlling signal for switching on/off the switching element;

inputting, per unit of one row of the piezoelectric elements, a row signal for switching the other of the pair of terminals of the piezoelectric element to a predetermined voltage applied state, a grounded state or an opened state; and ejecting the liquid droplet from the liquid droplet ejector by applying the voltage change between the pair of terminals of the piezoelectric element;

wherein the applying the voltage change is performed by charging and discharging so as to apply a voltage having a predetermined driving waveform to between the pair of terminals of the piezoelectric element, the charging and discharging is performed by inputting, per unit of one column of the piezoelectric elements, the column controlling signal, and inputting, per unit of one row of the piezoelectric elements, the row signal such that the switching element provided at the one of the pair of terminals of the piezoelectric element is switched on/off;

the other of the pair of terminals of the piezoelectric element is switched to the predetermined voltage applied state;

the other of the pair of terminals of the piezoelectric element is switched to the grounded state; and the other of the pair of terminals of the piezoelectric element is switched to the opened state.

2. The method for driving a liquid droplet ejecting head according to claim 1, wherein the column control signal for switching on/off the switching element is inputted to each column two or more times in a predetermined cycle.

3. The method for driving a liquid droplet ejecting head according to claim 1, wherein, per unit of one column of the piezoelectric elements, the column control signal for switching on/off the switching element is inputted to respective columns sequentially.

4. The method for driving a liquid droplet ejecting head according to claim 1, wherein the row signal is synchronized with the column control signal such that the opened state of the other of the pair of terminals of the piezoelectric element is switched to one of the grounded state, the predetermined voltage applied state or the opened state, and then the switched-state is switched to the opened state after maintaining the switched-state for a predetermined time.

5. The method for driving a liquid droplet ejecting head according to claim 1, wherein a row control signal individually turning a first switching element that can output a predetermined voltage and a second switching element that can ground the output side, on or off is inputted.

6. The method for driving a liquid droplet ejecting head according to claim 1, wherein a row control signal individually turning a first switching element that can output a predetermined voltage, a second switching element that can ground the output side, and a third switching element that can output a voltage different from the voltage outputted by the first switching element, on or off is inputted.

7. The method for driving a liquid droplet ejecting head according to claim 1, wherein, per unit of one row of the piezoelectric elements, the row signal for switching the other of the pair of terminals of the piezoelectric element to the predetermined voltage applied state, a voltage applied state in which the applied voltage is different from the predetermined voltage, or the grounded state, is inputted.

8. The method for driving a liquid droplet ejecting head according to claim 1, wherein the predetermined driving waveform is a substantially trapezoid shape.

9. A liquid droplet ejecting device comprising:

a plurality of liquid droplet ejectors that eject liquid droplets from nozzles according to respective voltage signals applied to a plurality of piezoelectric elements;

a matrix circuit including columns of piezoelectric elements and rows of piezoelectric elements in which, the piezoelectric elements are connected electrically in a matrix, switching elements are connected so as to be controllable per unit of one column of the piezoelectric elements, the switching element being provided with respect to each of the piezoelectric elements and capable of grounding one of a pair of terminals of the piezoelectric element, and the other terminals of the piezoelectric elements are connected per unit of one row of the piezoelectric elements;

a column control section that inputs, per unit of one column of the piezoelectric elements, a column control signal for switching on/off the switching element, to the matrix circuit;

a row control section that inputs, per unit of one row of the piezoelectric elements, a row signal for switching the other of the pair of terminals of the piezoelectric element to a predetermined voltage applied state, a grounded state or an opened state, to the matrix circuit; and a drive control section that drives each piezoelectric element to eject a liquid droplet from the liquid droplet ejector by controlling the output of the column control signal of the column control section and the output of the row signal of the row control section;

wherein the drive control section drives each piezoelectric element to eject a liquid droplet from the liquid droplet ejector by applying a voltage change between the pair of terminals of each piezoelectric element, and applying said voltage change is performed by charging and discharging so as to apply a voltage having a predetermined driving waveform to between the pair of terminals of the piezoelectric element, and the charging and discharging is performed by inputting, per unit of one column of the piezoelectric elements, the column controlling signal, and inputting, per unit of one row of the piezoelectric elements, the row signal such that the switching element provided at the one of the pair of terminals of the piezoelectric element is switched on/off, the other of the pair of terminals of the piezoelectric element is switched to the predetermined voltage applied state, the other of the pair of terminals of the piezoelectric element is switched to the grounded state, and the other of the pair of terminals of the piezoelectric element is switched to the opened state.

10. The liquid droplet ejecting device according to claim 9, wherein the column control section outputs the column control signal for switching on/off the switching element two or more times to each column in a predetermined cycle.

11. The liquid droplet ejecting device according to claim 9, wherein the column control section outputs, per unit of one column of the piezoelectric elements, the column control signal for switching on/off the switching element to respective columns sequentially.

12. The liquid droplet ejecting device according to claim 9, wherein the row control section outputs the row signal synchronously with the column control signal such that the opened state of the other of the pair of terminals of the piezoelectric element is switched to one of the grounded state, the predetermined voltage applied state or the opened state, and then the switched-state is switched to the opened state after maintaining the switched-state for a predetermined time.

13. The liquid droplet ejecting device according to claim 9, wherein the row control section inputs, per unit of one row of the piezoelectric elements, the row signal for switching the other of the pair of terminals of the piezoelectric element to the predetermined voltage applied state, a voltage applied state in which the applied voltage is different from the predetermined voltage, or the grounded state, to the matrix circuit.

14. The liquid droplet ejecting device according to claim 9, wherein the predetermined driving waveform is a substantially trapezoid shape.

15. The liquid droplet ejecting device according to claim 9, wherein, the row control section comprises a first switching element that can output a predetermined voltage, and a second switching element that can ground the output side, and a row control signal individually turning the first switching element and the second switching element on or off is inputted from the drive control section.

16. The liquid droplet ejecting device according to claim 15, wherein, the row control section further comprises a third switching element that can output a voltage different from the voltage outputted by the first switching element, and a row control signal individually turning the first switching element, the second switching element and the third switching element on or off is inputted from the drive control section.

* * * * *